US010094135B2

(12) United States Patent
Olsen

(10) Patent No.: US 10,094,135 B2
(45) Date of Patent: Oct. 9, 2018

(54) RETRACTABLE COLUMN AND METHOD OF FORMING

(71) Applicant: Tower Solutions, LLC, Minnetonka, MN (US)

(72) Inventor: Steven A. Olsen, Owatonna, MN (US)

(73) Assignee: Tower Solutions, LLC, Mendota Heights, MN (US)

( * ) Notice: Subject to any disclaimer, the term of this patent is extended or adjusted under 35 U.S.C. 154(b) by 0 days.

(21) Appl. No.: 15/386,341

(22) Filed: Dec. 21, 2016

(65) Prior Publication Data

US 2017/0101797 A1 Apr. 13, 2017

Related U.S. Application Data

(63) Continuation of application No. 14/275,386, filed on May 12, 2014, now Pat. No. 9,546,499, which is a (Continued)

(51) Int. Cl.
*E04H 12/18* (2006.01)
*E04H 12/34* (2006.01)
(Continued)

(52) U.S. Cl.
CPC ..... *E04H 12/185* (2013.01); *B66F 3/06* (2013.01); *E04G 1/22* (2013.01); *E04G 11/48* (2013.01);
(Continued)

(58) Field of Classification Search
CPC ..... E04H 12/00; E04H 12/345; E04H 12/18; E04H 12/34; E04H 12/187; E04H 12/185;
(Continued)

(56) References Cited

U.S. PATENT DOCUMENTS 363,889 A 5/1887 Gillespie
999,126 A 7/1911 Sistermann
(Continued)

FOREIGN PATENT DOCUMENTS

| | | |
|---|---|---|
| EP | 0 399 215 | 11/1990 |
| FR | 2587399 | 3/1987 |
| GB | 2074981 | 11/1981 |

OTHER PUBLICATIONS

International Application No. PCT/US2001/029741, filed Sep. 21, 2001, International Search Report dated Apr. 4, 2002 and International Preliminary Examination Report dated May 23, 2003.

*Primary Examiner* — Phi D A
(74) *Attorney, Agent, or Firm* — Moore & Hansen, PLLC; Conrad A. Hansen

(57) ABSTRACT

The present invention is an improved apparatus and method for forming a retractable tower or column. The present invention includes pointed hooks wherein the hooks are attached to each section of a section chain, one in a horizontal direction and one in an off-set manner. The section chains are placed on a take up mechanism in an operable position and then raised utilizing a motor. As the section chains are raised, they are guided by a guide tower, rollers, shims, and gear racks into a position whereby hooks from adjacent sections of the section chains form coupled engagements. The coupled engagement of the hooks of the sections of each adjacent section chains thereby form the column.

1 Claim, 28 Drawing Sheets

Related U.S. Application Data continuation of application No. 13/553,409, filed on Jul. 19, 2012, now Pat. No. 8,720,127, which is a continuation of application No. 13/084,285, filed on Apr. 11, 2011, now Pat. No. 8,225,559, which is a continuation of application No. 12/533,054, filed on Jul. 31, 2009, now Pat. No. 7,921,611, which is a continuation of application No. 11/552,858, filed on Oct. 25, 2006, now Pat. No. 7,581,360, which is a continuation of application No. 09/960,537, filed on Sep. 21, 2001, now Pat. No. 7,310,915.

(60) Provisional application No. 60/234,624, filed on Sep. 22, 2000.

(51) Int. Cl.

| | |
|---|---|
| ***B66F 3/06*** | (2006.01) |
| ***E04G 1/22*** | (2006.01) |
| ***E04G 11/48*** | (2006.01) |
| ***E04H 12/00*** | (2006.01) |

(52) U.S. Cl.
CPC ..... *E04H 12/00* (2013.01); *E04H 12/344* (2013.01); *E04H 12/345* (2013.01); *E04H 12/18* (2013.01); *E04H 12/34* (2013.01)

(58) Field of Classification Search
CPC ..... E04H 12/182; E04G 11/48; E04G 1/22; B66F 3/06; E04B 1/343; E04B 1/34305; E04B 1/34357; E04B 1/34384
See application file for complete search history.

(56) References Cited

U.S. PATENT DOCUMENTS 1,054,737 A 3/1913 Woodbury
1,973,741 A 9/1934 Bauer
2,130,993 A 9/1938 Dubiller
2,149,918 A 3/1939 Komorous
2,269,363 A 1/1942 Farrand
2,357,165 A 8/1944 Brady
2,375,461 A 5/1945 Bender
2,375,462 A 5/1945 Bender
2,481,471 A 9/1949 Crot
2,620,904 A 12/1952 Le Roy
2,643,745 A 6/1953 Olszewski
2,661,082 A * 12/1953 Ziegler ..... E04H 12/185 182/102
2,725,959 A 12/1955 Plano
2,767,812 A 10/1956 Boger
2,794,612 A 6/1957 Clifton
2,795,303 A 6/1957 Muehlhause et al.
2,799,368 A 7/1957 Alter
2,806,562 A 9/1957 Harman
2,844,232 A 7/1958 Le Roy
2,857,994 A 10/1958 Sheard
2,905,282 A 9/1959 Miller
2,948,363 A 8/1960 Hopfeld
2,987,148 A 6/1961 Millard
3,000,473 A 9/1961 Reynolds
3,012,635 A * 12/1961 Blain ..... B66F 3/06 187/250
3,016,988 A * 1/1962 Browning ..... B66F 11/00 187/250
3,101,816 A 8/1963 Fox
3,203,657 A 8/1965 Thompson
3,204,721 A 9/1965 Park
3,213,573 A 10/1965 Bohr et al.
3,213,575 A 10/1965 Boczek
3,233,722 A 2/1966 Jorgensen
3,242,576 A 3/1966 Wheeler
3,319,987 A 5/1967 Bohr et al.
3,328,921 A 7/1967 Keslin
3,354,596 A 11/1967 Schafer
3,371,458 A 3/1968 Sturgill
3,385,397 A * 5/1968 Robinsky ..... E04H 12/185 182/41
3,397,546 A 8/1968 Eisert et al.
3,486,279 A 12/1969 Mauch
3,503,164 A 3/1970 Medal et al.
3,672,104 A 6/1972 Luckey
3,684,056 A 8/1972 Penso
3,800,965 A 4/1974 Barron et al.
3,805,462 A 4/1974 Caperton
3,844,083 A 10/1974 Farley, Jr.
3,900,305 A 8/1975 DeLuca
3,934,741 A 1/1976 Wentz
4,003,296 A 1/1977 Wentz
4,024,595 A 5/1977 Brown
4,027,440 A * 6/1977 Hamblin ..... E04H 12/185 182/41
4,089,147 A 5/1978 Bain
4,224,005 A 9/1980 Dysarz
4,235,345 A 11/1980 VandeDrink et al.
4,237,662 A 12/1980 Kinzler
4,337,845 A 7/1982 Zelli et al.
4,386,485 A * 6/1983 Kramer ..... E04H 12/185 52/108
4,406,096 A 9/1983 Matsutani
4,491,231 A 1/1985 Heggeland
4,587,777 A 5/1986 Vasques et al.
4,651,480 A * 3/1987 Kramer ..... E04H 12/185 182/41
4,726,247 A 2/1988 Hormann
4,729,754 A 3/1988 Thuerman
4,745,714 A 5/1988 Matsutani
4,785,576 A 11/1988 Morgan
4,829,739 A 5/1989 Coppa
4,830,337 A * 5/1989 Ichiro ..... B23Q 7/1431 254/95
4,850,161 A * 7/1989 McGinnis ..... E04H 12/20 52/108
4,866,893 A 9/1989 McGinnis
4,883,186 A 11/1989 Werber
4,884,382 A 12/1989 Horobin
4,884,659 A 12/1989 Chao
4,920,710 A 5/1990 Paine
4,932,176 A 6/1990 Roberts
4,984,133 A 1/1991 Casanova et al.
5,056,278 A 10/1991 Atsukawa
5,092,822 A 3/1992 Wakabayashi
5,102,375 A 4/1992 Featherstone
5,139,464 A 8/1992 Lehnert
5,154,027 A * 10/1992 Warden ..... E04H 12/185 343/880
5,168,679 A * 12/1992 Featherstone ..... B66F 3/06 52/108
5,184,444 A 2/1993 Warden
5,203,746 A 4/1993 Lehnert
5,249,396 A * 10/1993 Zuse ..... E04H 12/185 52/108
5,287,966 A 2/1994 Stahl
5,557,892 A 9/1996 Lavin
5,570,546 A 11/1996 Butterworth
5,575,701 A 11/1996 Hantman
6,041,558 A 3/2000 Sylvestre
6,098,758 A 8/2000 Gates
6,112,474 A * 9/2000 Paine ..... E04H 12/185 242/390.2
6,237,750 B1 5/2001 Damkjaer et al.

* cited by examiner

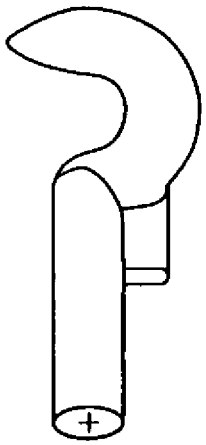
FIG. 2
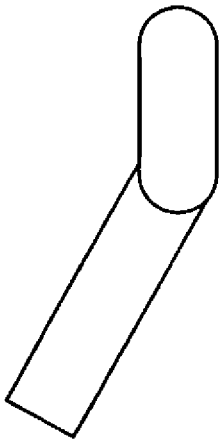
FIG. 3
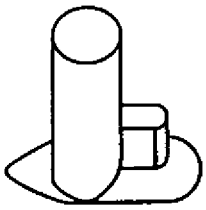
FIG. 4
FIG. 5
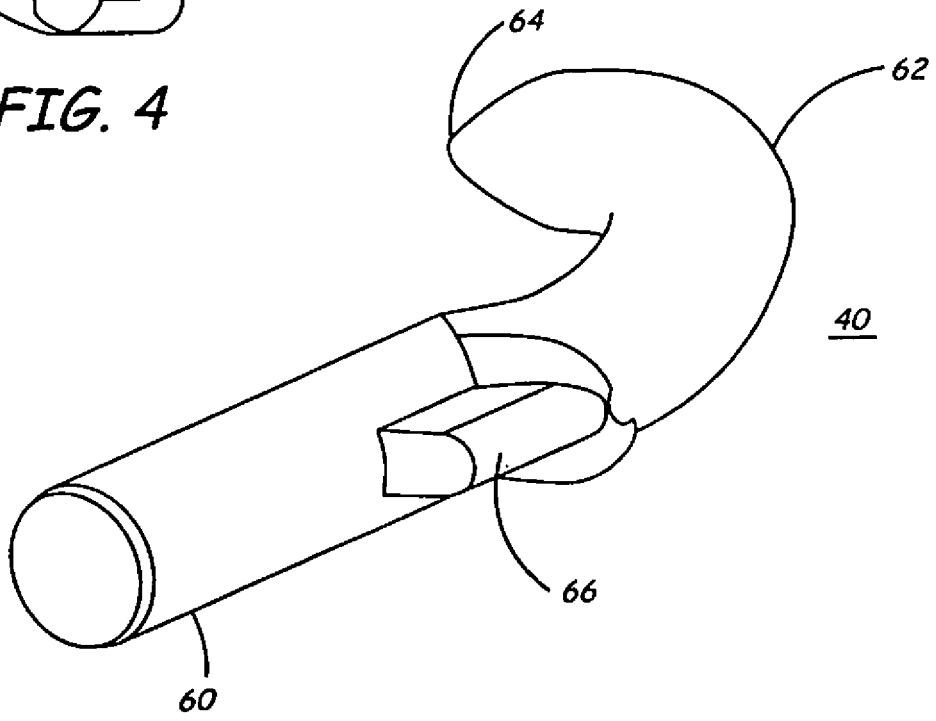

RETRACTABLE COLUMN AND METHOD OF FORMING

CROSS-REFERENCE TO RELATED APPLICATIONS

This application is a continuation of U.S. application Ser. No. 14/275,386, filed on May 12, 2014, which is a continuation of U.S. application Ser. No. 13/553,409, filed on Jul. 19, 2012, now U.S. Pat. No. 8,720,127, which is a continuation of U.S. application Ser. No. 13/084,285, filed on Apr. 11, 2011, now U.S. Pat. No. 8,225,559, which is a continuation of U.S. application Ser. No. 12/533,054, filed on Jul. 31, 2009, now U.S. Pat. No. 7,921,611, which is a continuation of U.S. application Ser. No. 11/552,858, filed on Oct. 25, 2006, now U.S. Pat. No. 7,581,360, which is a continuation of U.S. application Ser. No. 09/960,537, filed on Sep. 21, 2001, now U.S. Pat. No. 7,310,915, which claims the benefit of U.S. Provisional Application No. 60/234,624, filed on Sep. 22, 2000, which applications are incorporated herein by reference in their entirety.

FIELD OF THE INVENTION

This invention relates generally to support columns, and more specifically, to an improved retractable support column for use in supporting overhead structures that can be extended from a portable or fixed in place platform.

BACKGROUND

Link structures that can be linked together to form a rigid structure are well known in the art. Structures of this kind may be used to form a platform to elevate a person or equipment, to form a bridge to permit a user to pass over an obstacle, or to form a dock. Additionally, such structures have been used in space applications to extend a flexible sheet of material or to form a tower as a structure in space. See U.S. Pat. Nos. 2,661,082, 3,397,546, 4,024,595, 4,089,147, and 4,237,662.

Retractable towers of this kind may be further utilized as a portable telecommunications tower, wherein various sites can be tested without constructing a costly test tower at a location to discover it was not effective for the intended purpose. Retractable towers may also be used as temporary lighting systems for sporting events, emergencies, or on ships. Other applications may also be present in a variety of other fields and a variety of other situations.

The formation of retractable columns has been previously described. U.S. Pat. No. 4,920,710 to David L. Paine previously described a retractable support column for use in lifting and suspending overhead structures, which is herein incorporated by reference for everything it discloses. The structures that were formed using this apparatus and method, however, were subject to poor interconnection of the tower sections. The poor connection of the sides of the tower was caused in part by poor alignment of the section chains, and through the hooks, as the sides were raised. Poor alignment of the adjacent sections resulted in a poorly constructed tower; when a large amount of stress was placed on the poorly aligned tower, it sometimes resulted in the shearing of the pins holding the tower. The shearing of the pins resulted in a low structural integrity for the tower. These problems increased the difficulty in using tower systems of this type and also increased safety concerns and dangers.

Accordingly, there is a need for an improved retractable tower structure that provides greater structural integrity.

There is a further need for a retractable tower which is more reliable, which provides a sturdier tower under adverse conditions, and which increases the load bearing characteristics of towers.

SUMMARY OF THE INVENTION

The present invention is an improved retractable tower which fills a variety of useful functions known in the art and which meets the needs in the art by providing greater stability and resistance to shear caused by wind, ice, snow, and other adverse weather conditions, which provides a sturdier structure and which increases the load bearing capacity. The present embodiment accomplishes these needs by incorporating a number of new features, among others, an improved chain connection member, an improved guide system, an improved support and connection system, and an improved take up mechanism. These systems function individually and in combination to form a more secure locking engagement with the adjacent section chains, and to form a more structurally sound and stable tower. A retractable column comprising at least two section chains arranged in an adjacent manner is described, each section chain having a plurality of sections pivotally connected to each other, at least one chain connection member extending in an outward direction from each section whereby the chain connection members have a surface, the surface of the chain connection members converging towards a point, and whereby the chain connection members couple to one another to link each section chain to the adjacent section chain in such a manner as to form a rigid column.

A retractable column that can be stored on a take up mechanism is described, the column further comprising, at least one section chain, each section chain comprising a plurality of sections pivotally connected in a line, the section chains being attached in such a manner that they can be rolled up on the take mechanism in a compact fashion and wherein each section is layered upon previous sections, a first connection member operably attached to each section wherein the first connection member extends in a horizontal manner from the section, a second connection member operably attached to each section wherein the second connection member extends in an off-set manner from the section, wherein the connection members are curved and wherein when the section chains are extended from the take up mechanism and into a corresponding position the section chains operably couple by attachment of the sequential attachment of first connection members to second connection members.

An apparatus for raising a retractable column is described, the apparatus comprising at least one section chain, the section chains operably positioned so that they may be raised and lowered concurrently, the raising and lowering of each section chain acting to couple each section chain to the adjacent section chains to form a column, a guide tower, the guide tower situated so that as the section chains are raised, the section chains move up the length of the guide tower and are guided into a position that facilitates the coupling of each section chain to the adjacent section chains to form a column, at least one guide roller, the guide roller operably attached to the guide tower so that the guide roller operatively interacts with a portion of the sections of the section chains to guide the section chains into position where each section chain may be physically coupled to the section chains adjacent to it, at least one shim, each shim operably attached to the guide tower, the shims providing an adjustable platform for guiding the sections of the section chains into a position whereby the coupling of the adjacent section chains will be accomplished, and further comprising a motor operably affixed to the guide tower, the motor effectuating the raising and lowering of each section chain.

A retractable column for supporting an overhead structure is described, the column further comprising, at least one section chain, each section chain comprising a plurality of sections pivotally connected in a line, the section chains being attached in such a manner that they can be rolled up on a take mechanism in a compact fashion with each section layered upon prior sections, a first hook attached to each section of the section chains, the first hook extending in a horizontal manner from each section, a second hook attached to the opposite side of each section from the first hook and in an off-set manner whereby each first hook on a section is adjacent to a second offset hook on an adjacent section, whereby when the section chains are raised in a concurrent manner, the first hooks form an interlocking engagement with the second hooks from adjacent sections, the interlocking engagement binding each section chain to the adjacent section chains.

A method for erecting a retractable tower is described, the method comprising, providing adjacent section chains, each chain further comprising a series of pivotally connected sections, coupling the adjacent sections of adjacent section chains by linking corresponding mating hooks from each section chain, and lifting the coupled section chains in a vertical manner as the adjacent section chains are coupled thereby forming each section chain into the face of a tower.

BRIEF DESCRIPTION OF THE ACCOMPANYING FIGURES

FIG. 1*a* is an elevational rear view of a portion of the section chain of the present invention.

FIG. 1*b* is an elevational rear view of one of the sections of the section chain of the present invention.

FIG. 2 is a front view of a chain connection member.

FIG. 3 is a rear view of the chain connection member of FIG. 2.

FIG. 4 is an end on view of the chain connection member of FIG. 2.

FIG. 5 is an isometric view of the chain connection member of FIG. 2.

Figure 13A:
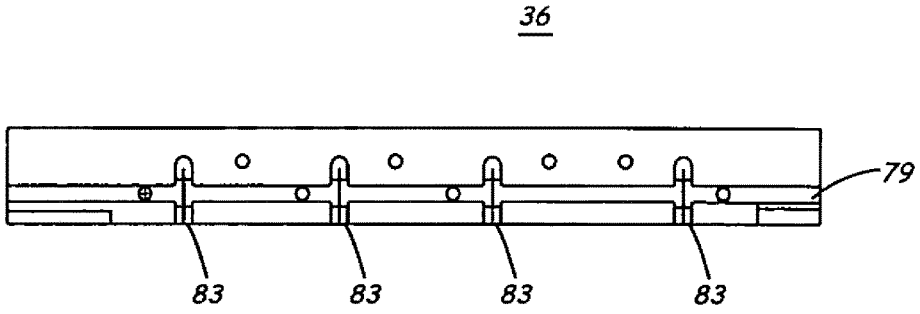

FIG. 13*a* is a rear view of the gear rack.

Figure 13B:
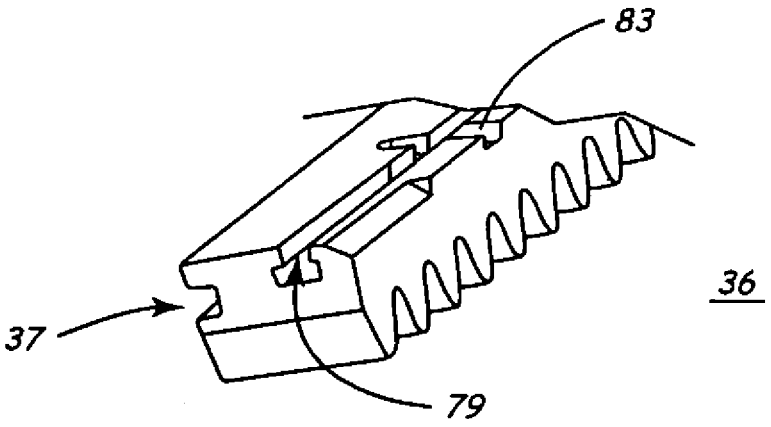

FIG. 13*b* is an isometric view of one end of the gear rack.

Figure 13C:
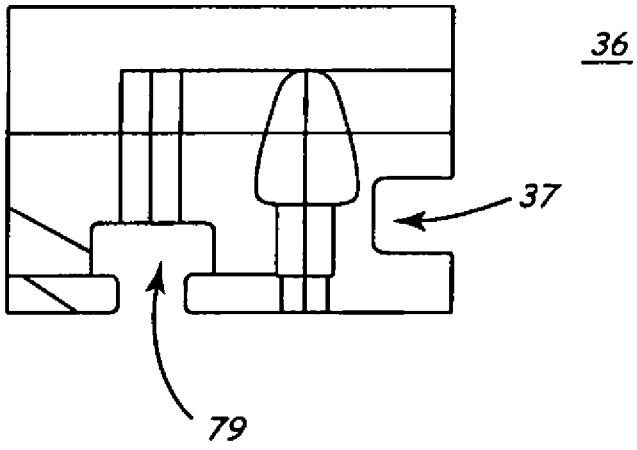

FIG. 13*c* is an end view of the gear rack.

Figure 14:
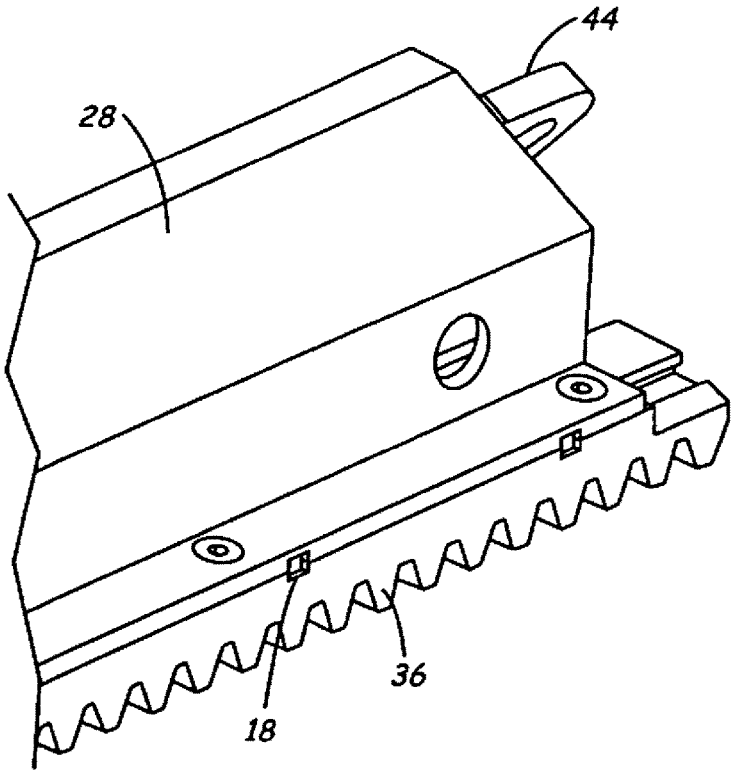

FIG. 14 is a view of the end of the gear rack attached to the vertical strut.

Figure 15:
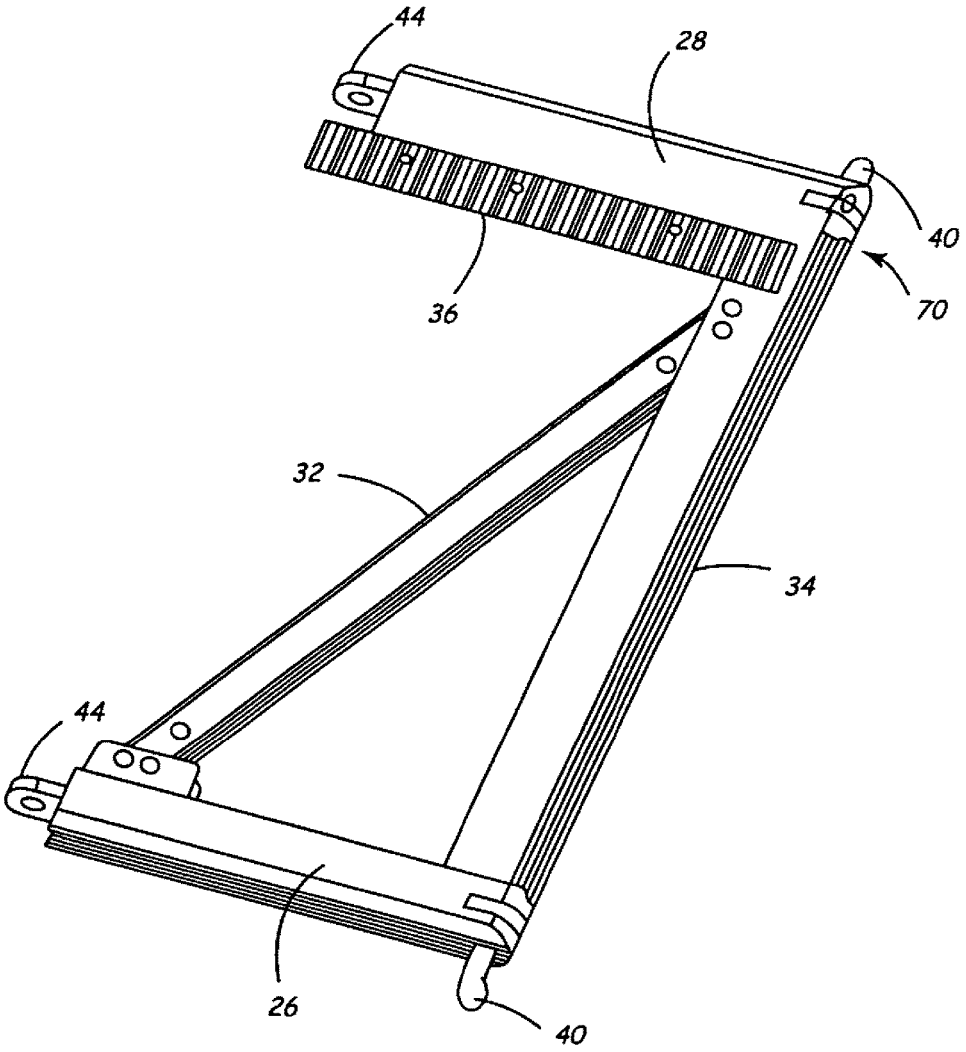

FIG. 15 is an isometric view of a section of the present invention.

Figure 16:
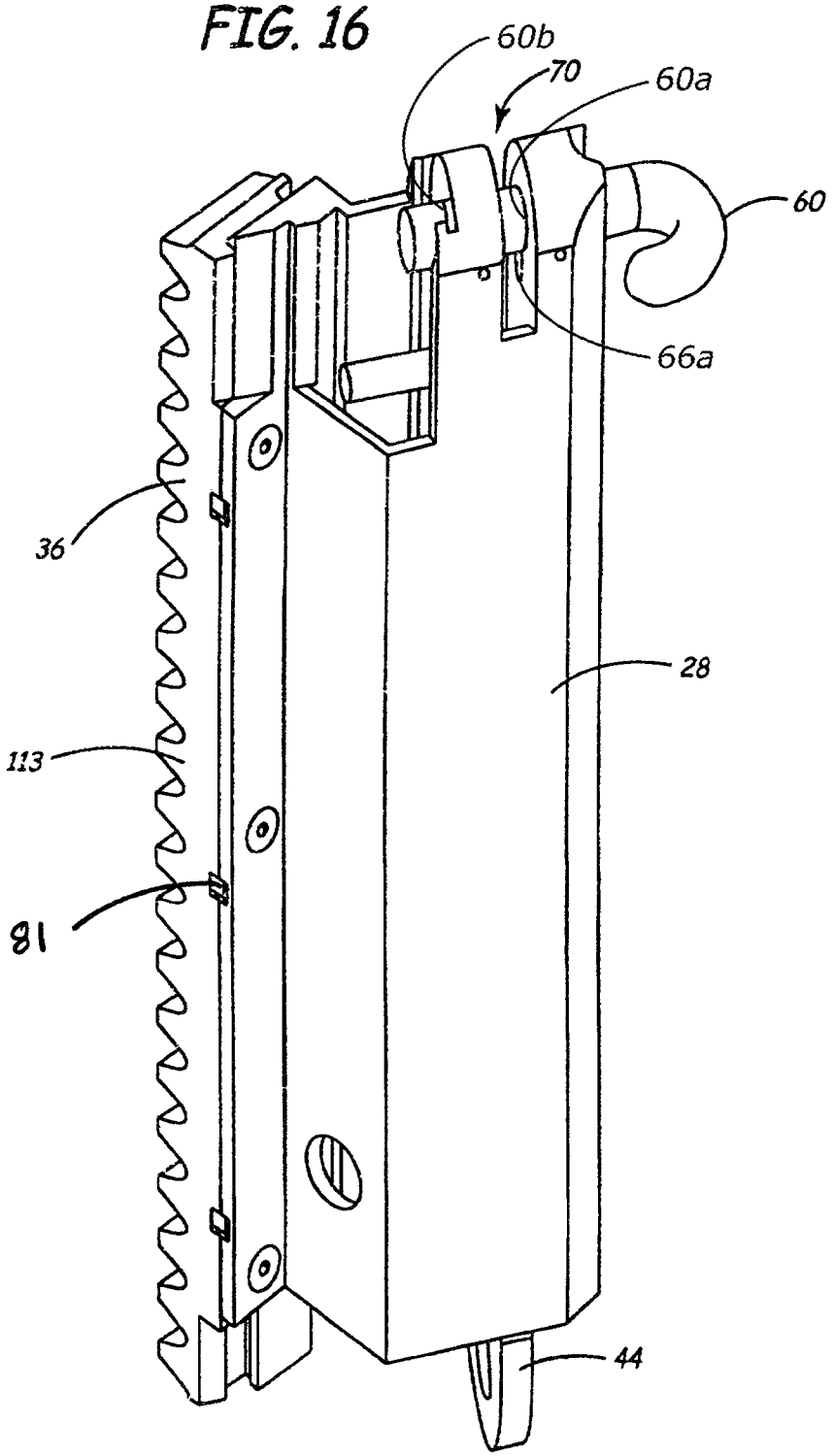

FIG. 16 is a side cut away view of the vertical strut with the gear rack attached.

Figure 17:
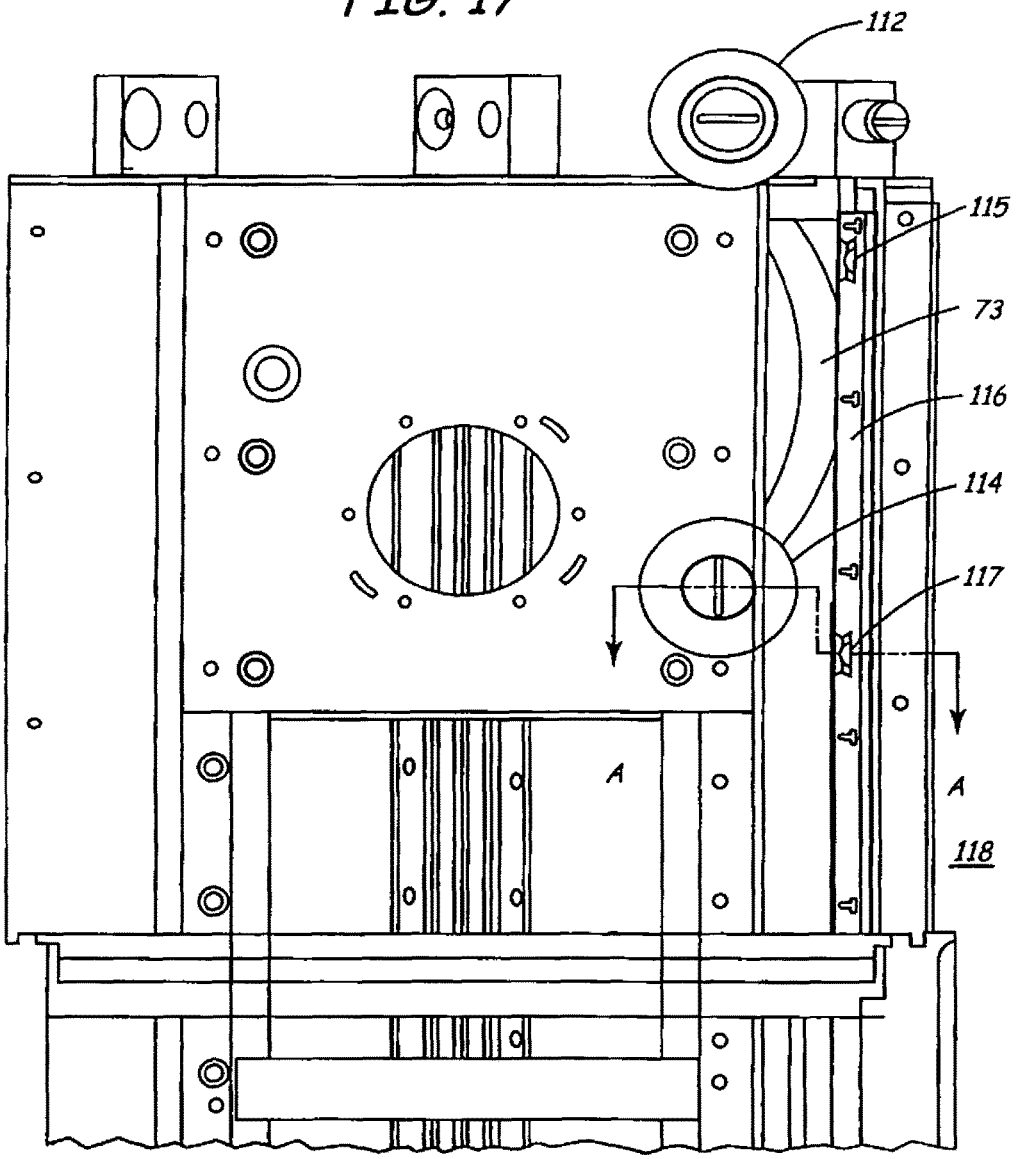

FIG. 17 is a side view of one side of the guide column of the present invention.

Figure 18:
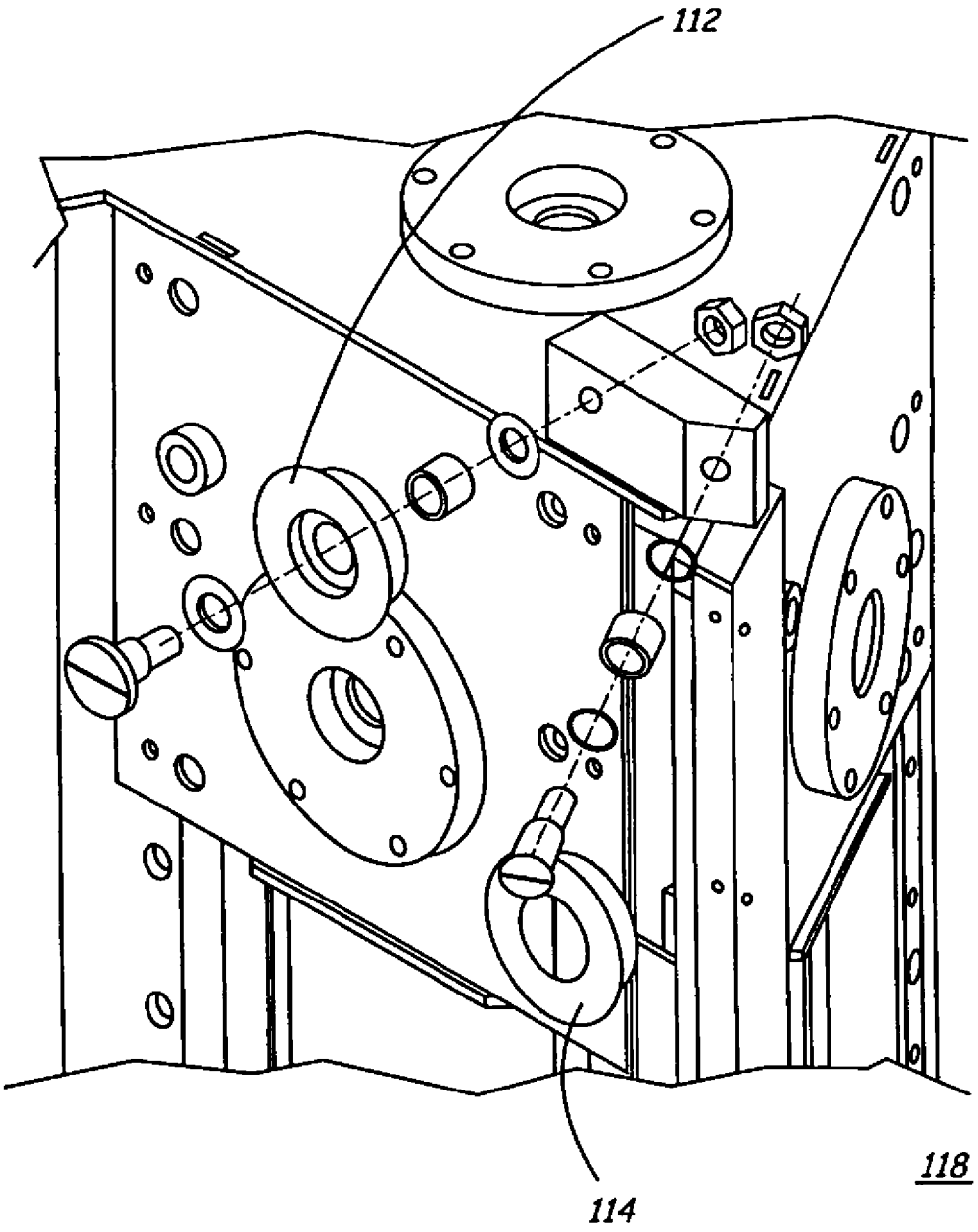

FIG. 18 is an isometric view of one corner of the guide column of the present invention.

Figure 19:
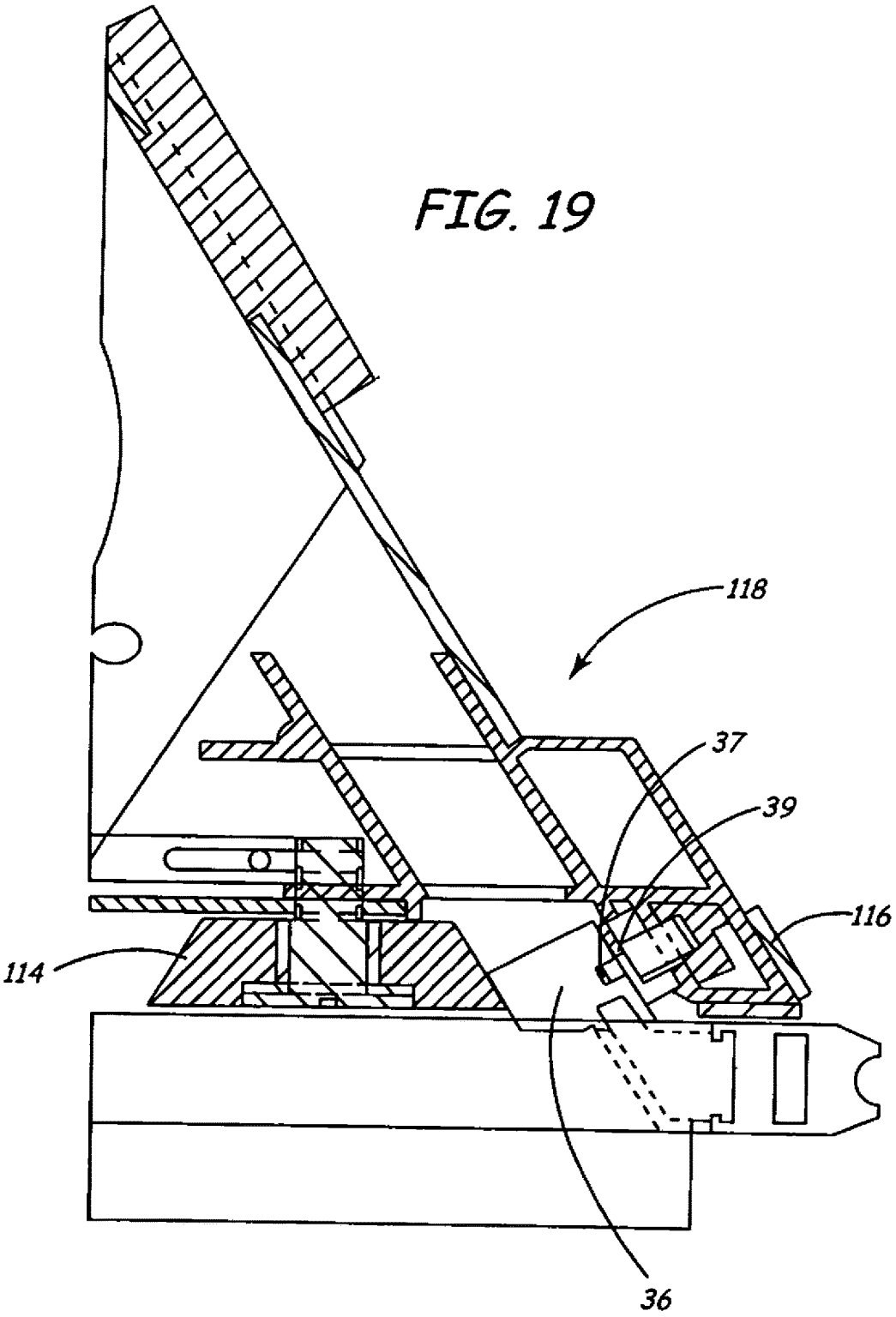

FIG. 19 is an over the top cut away view of the guide column of the present invention.

Figure 20:
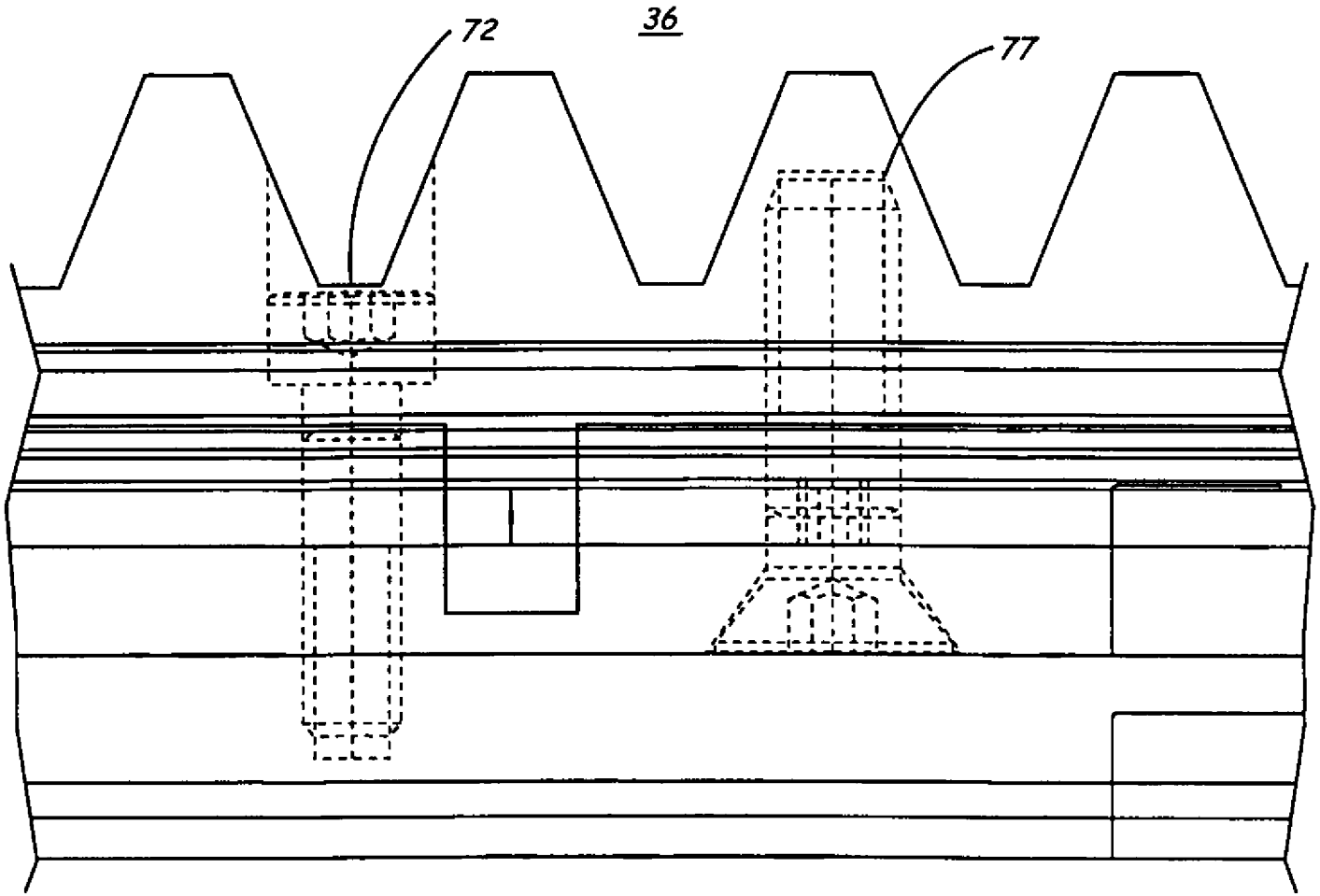

FIG. 20 is a cut away view of the gear rack of the present invention.

Figure 21:
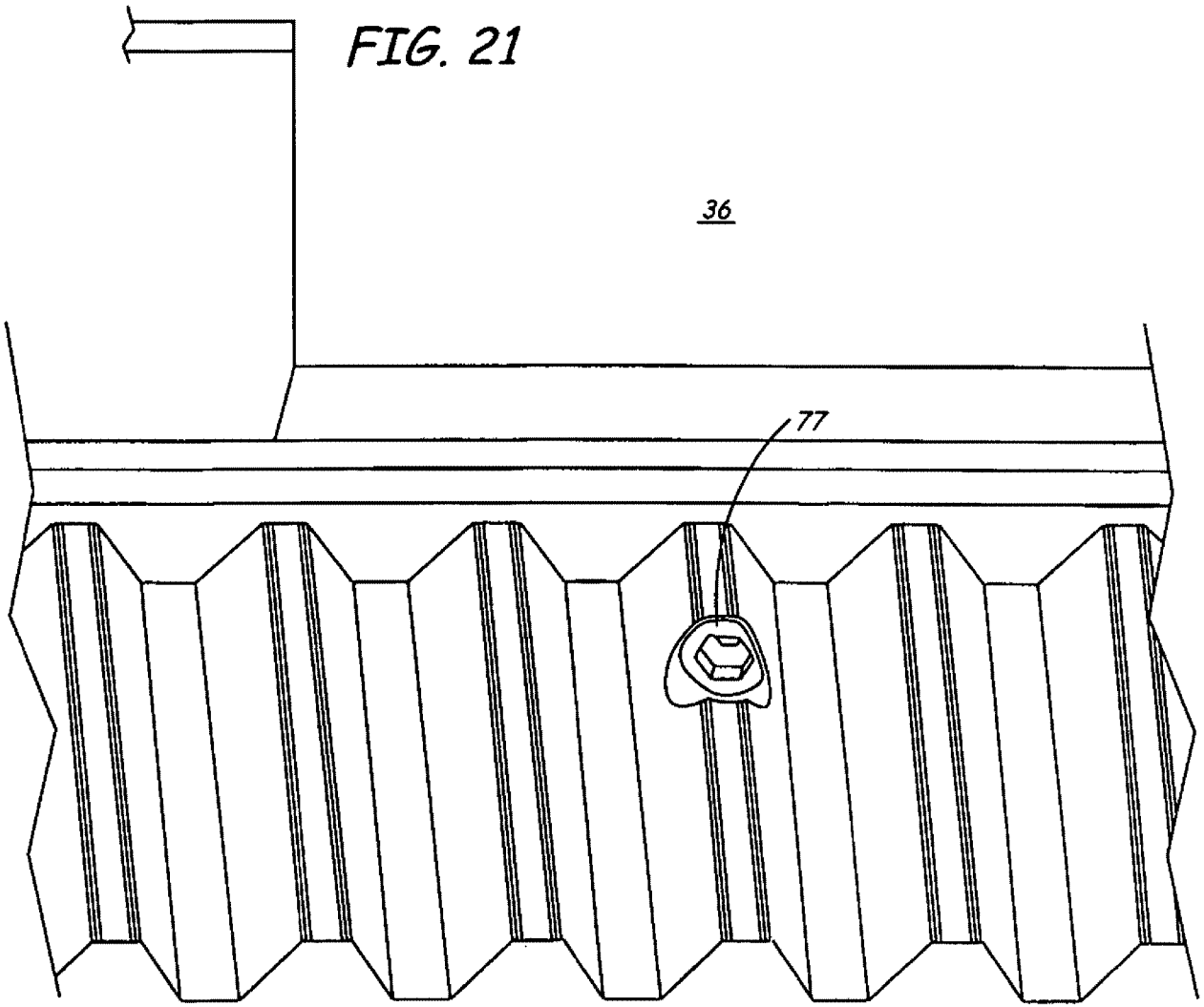

FIG. 21 is an isometric view of the gear rack of the present invention.

Figure 22:
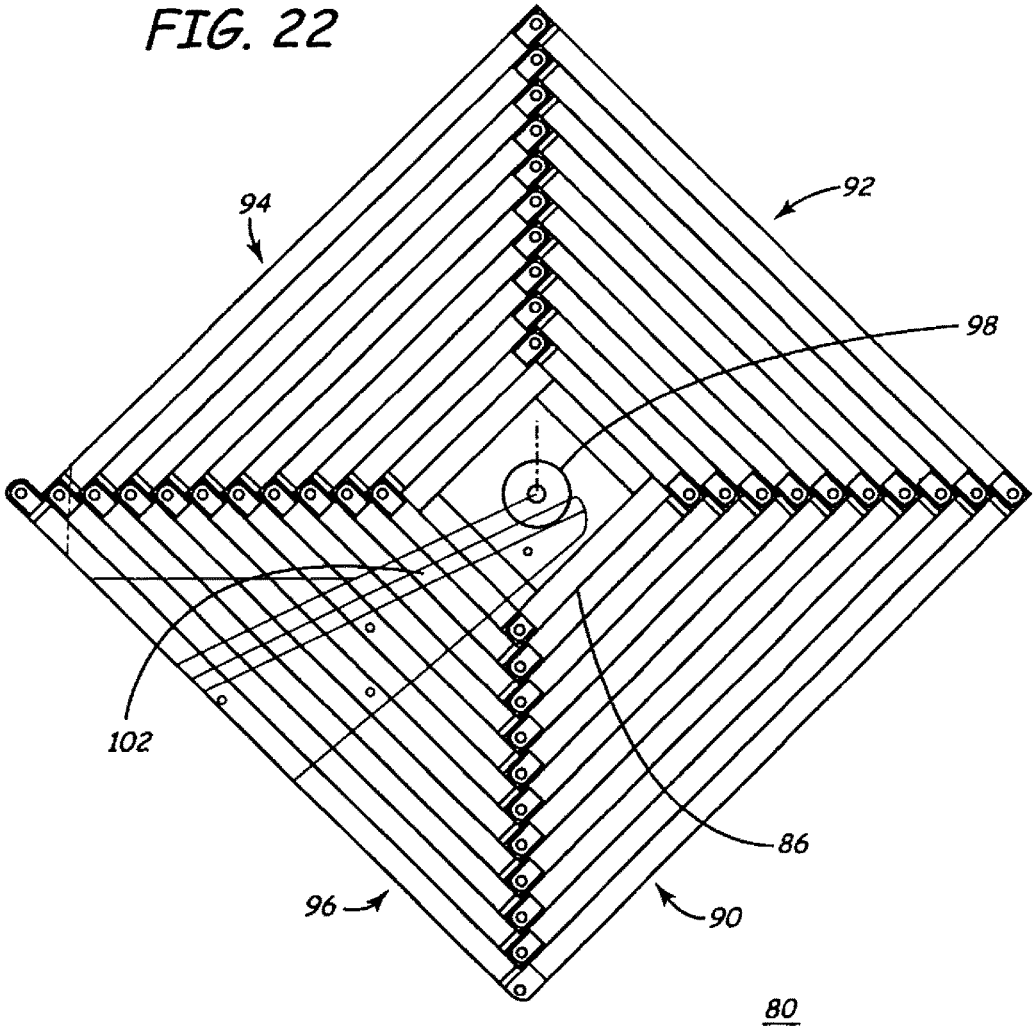

FIG. 22 is a front view of the take up mechanism of the present invention with sections of a section chain stored on the same.

Figure 23:
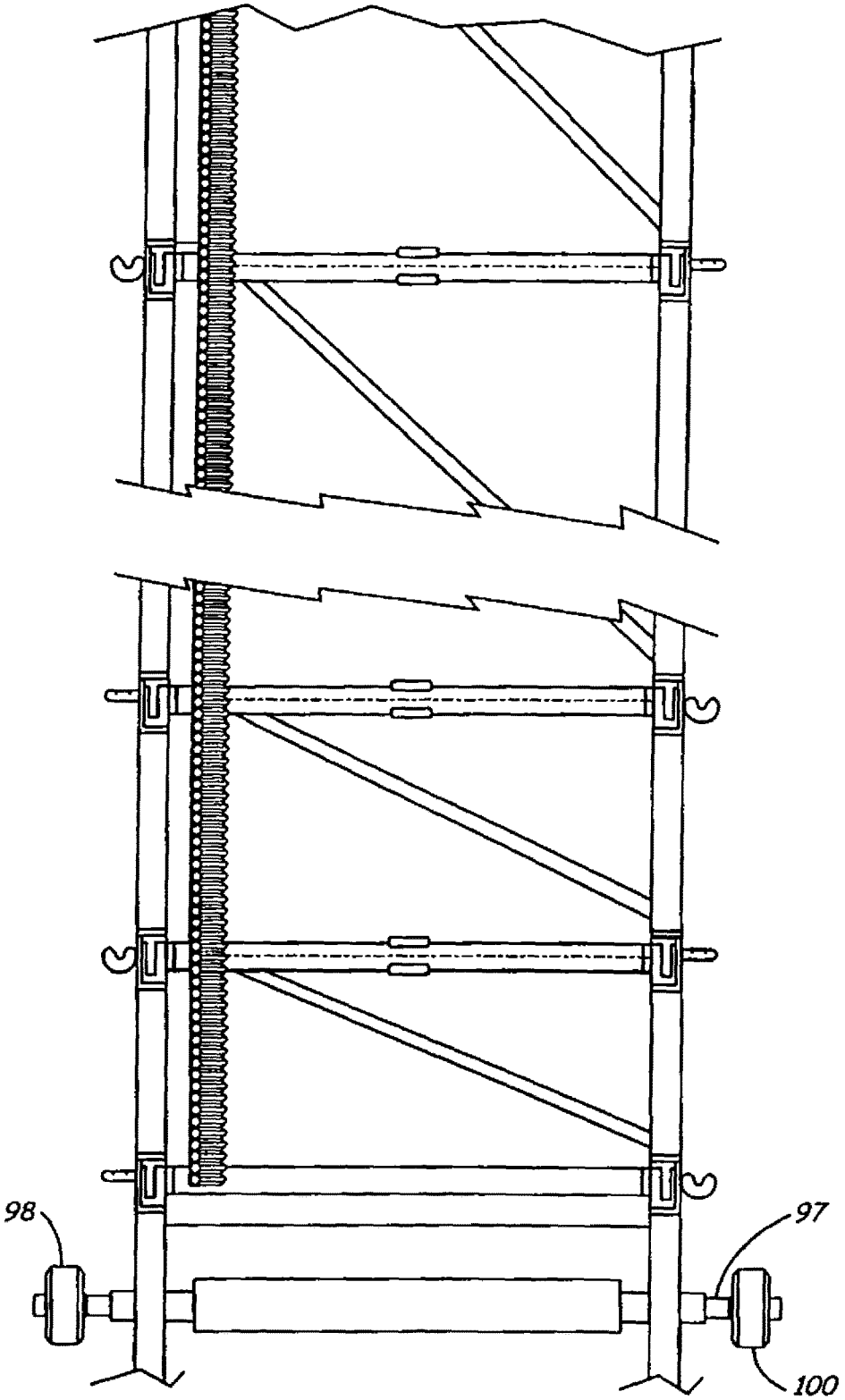

FIG. 23 is a front view of section chain of the present invention with the rollers and the guide rod attached to one end.

Figure 24:
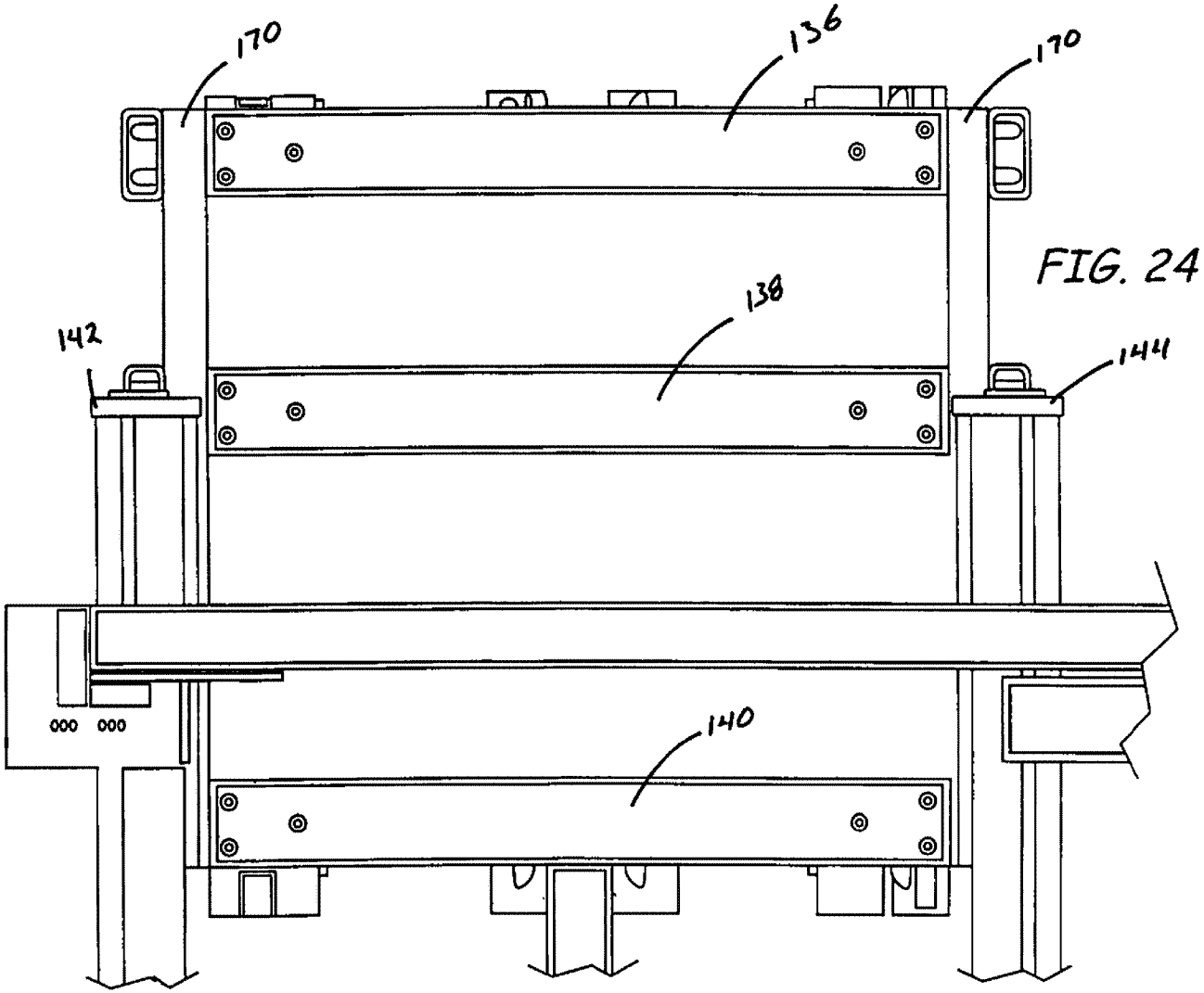

FIG. 24 is a side view of the guide tower of an alternative embodiment of the present invention.

Figure 25:
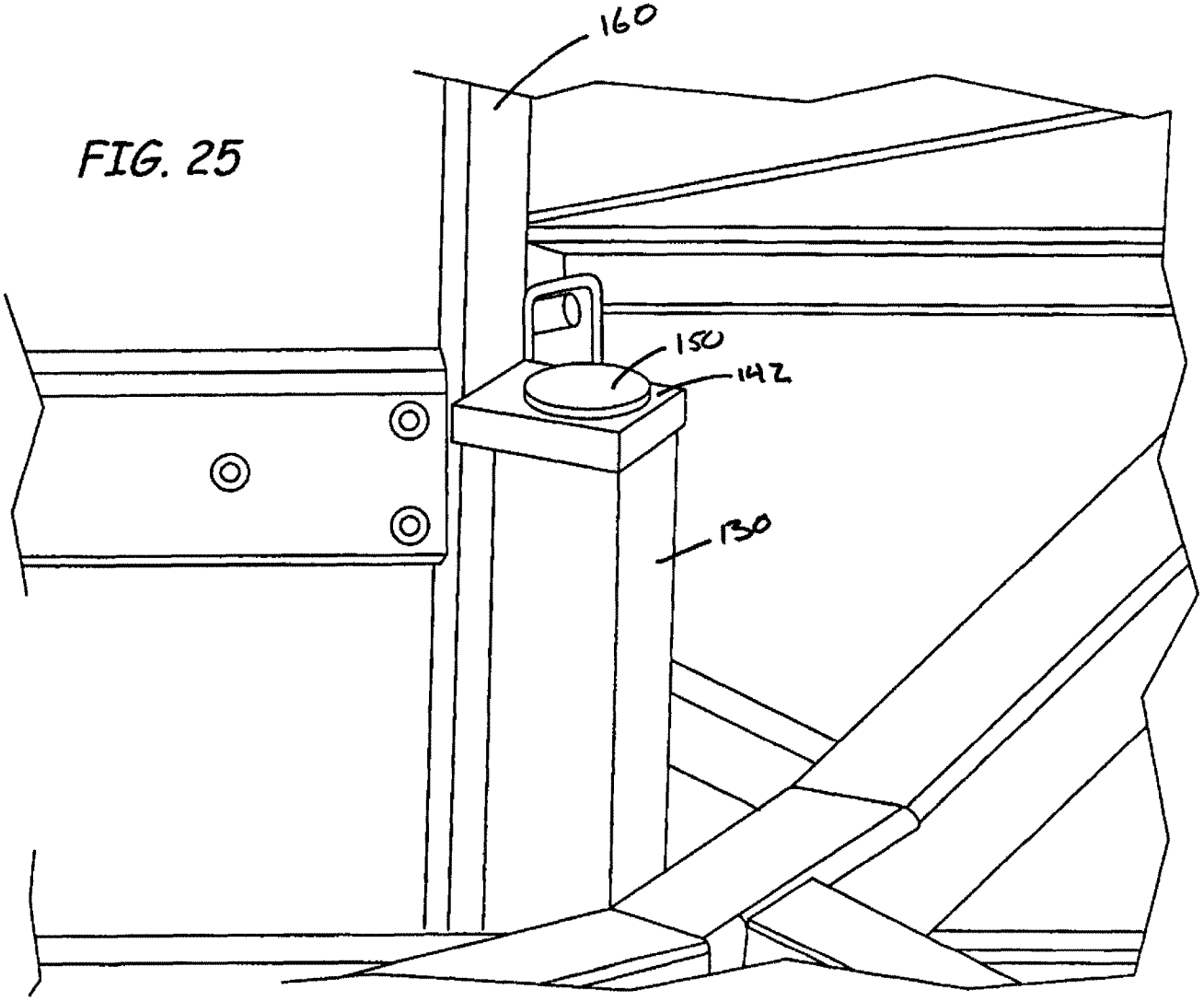

FIG. 25 is an elevational isometric view of the alternative embodiment of FIG. 24.

Figure 26A:
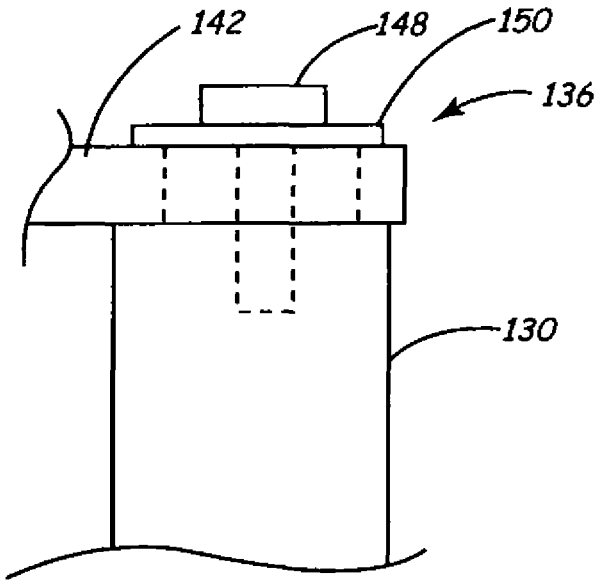

FIG. 26*a* is a cut away view of the section ring of an alternative embodiment.

Figure 26B:
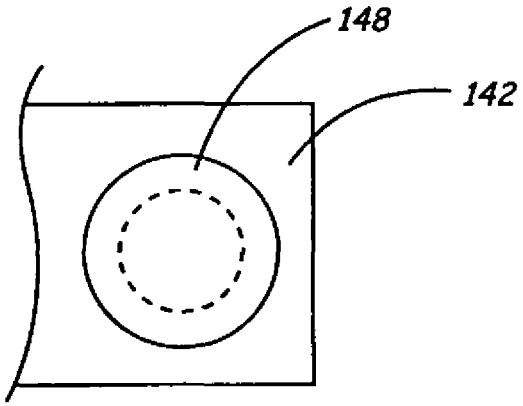

FIG. 26*b* is an over the top sectional view of the tongue of an alternative embodiment.

Figure 27C:
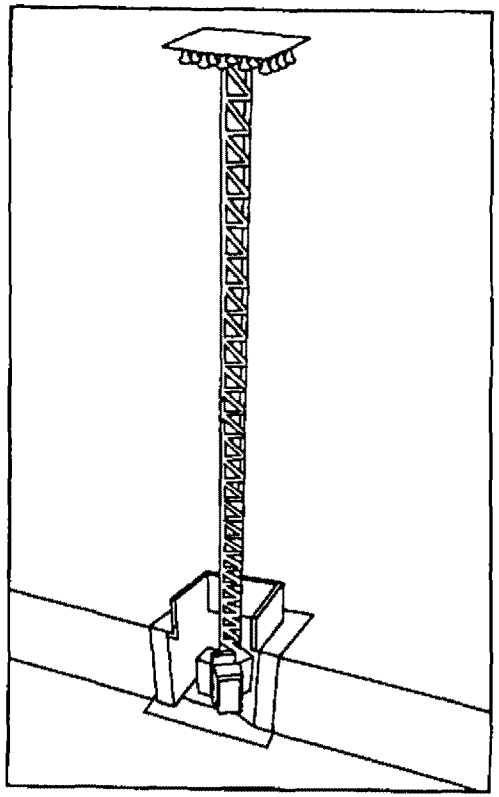
Figure 27B:
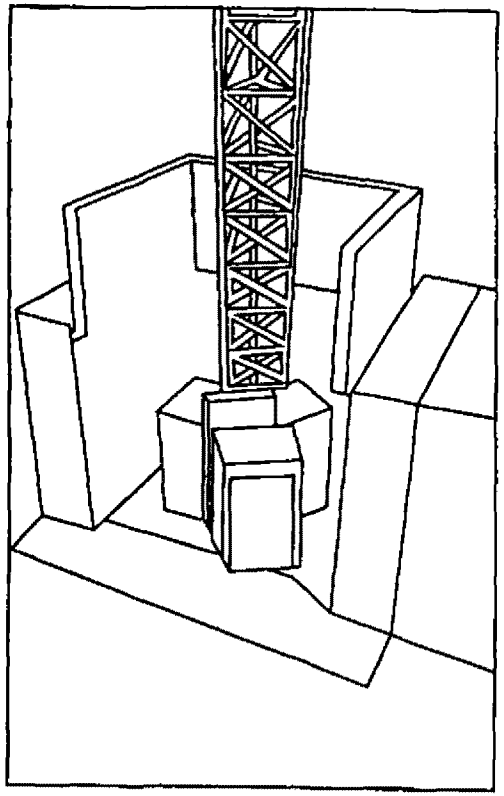
Figure 27A:
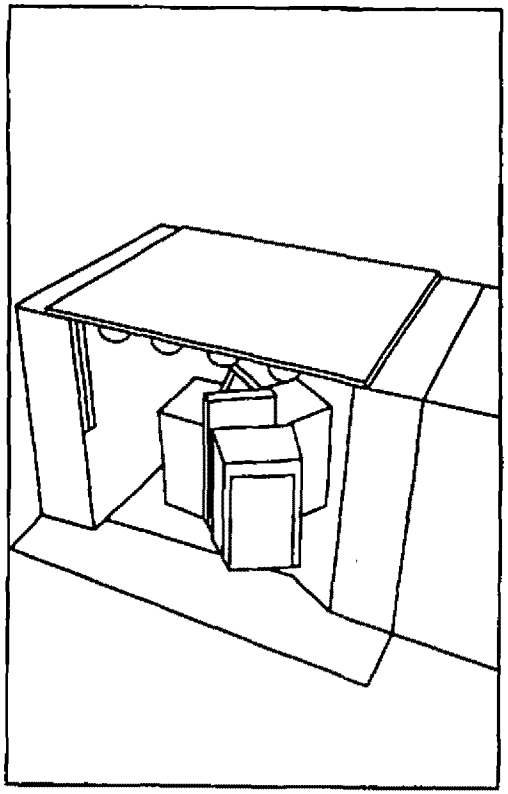

FIG. 27*a* is an isometric view of the fixed in place embodiment of the present invention in the non-extended position.

FIG. 27*b* is an isometric view of the fixed in place embodiment of the present invention in the extended position.

FIG. 27*c* is an isometric view of the fixed in place embodiment of the present invention in the extended position.

Figure 28:
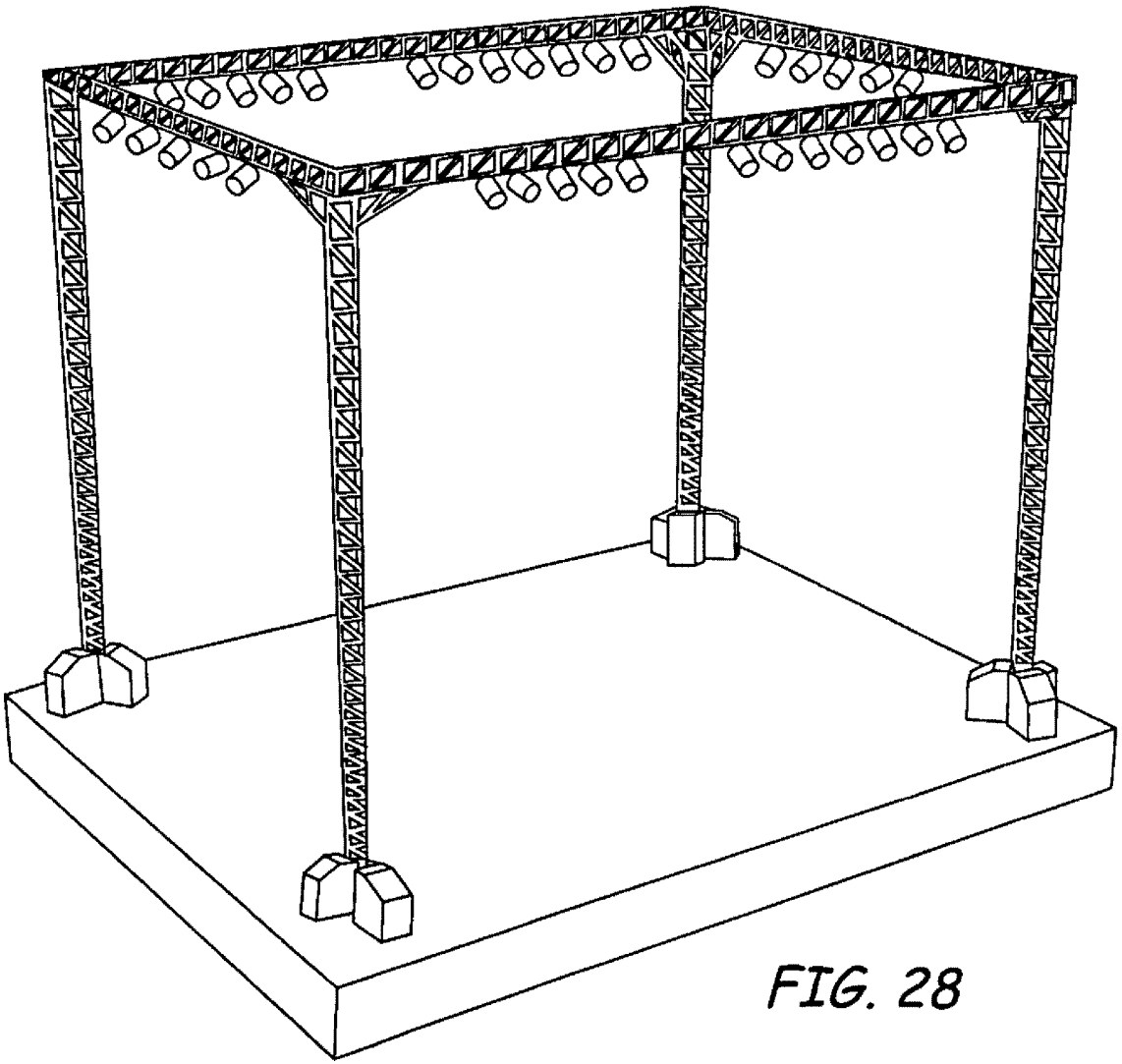

FIG. 28 is an isometric view of several towers of the present invention in the extended position with a light assembly interconnecting the top of each tower.

Figure 29:
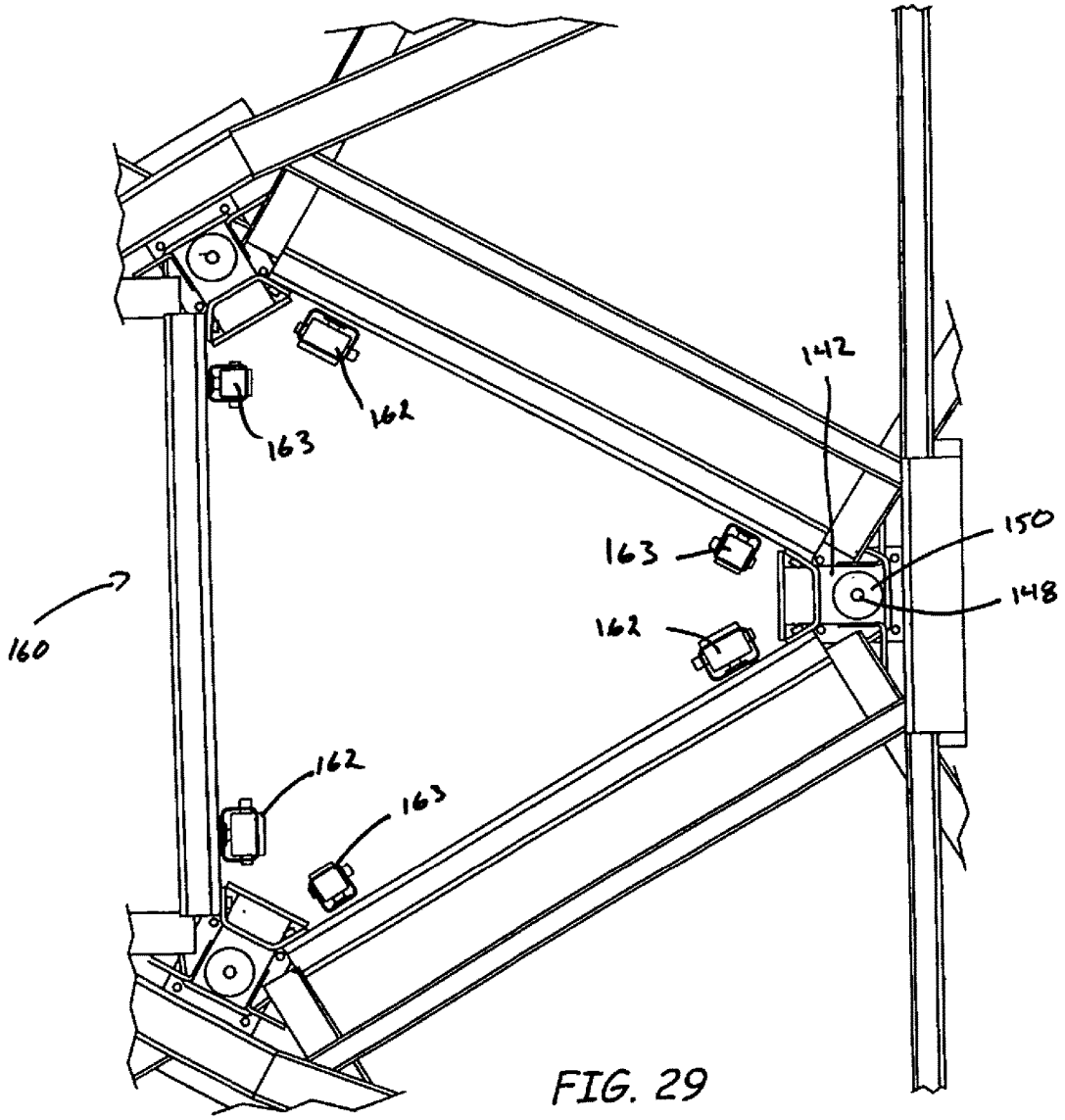

FIG. 29 is a top view of an alternative embodiment tower.

DESCRIPTION OF THE EMBODIMENTS

Additional features of the apparatus of the present invention will become more fully apparent and understood with reference to the above-referenced drawings, this description, and the appended claims, including the described embodiments of the extendable support column, and the description of erecting the device.

The accompanying Figures and descriptive material depict and describe embodiments of the present invention, including features and components thereof. With regard to fastening, mounting, attaching or connecting the components of the present invention to form the device or apparatus as a whole, unless specifically described otherwise, the invention may incorporate or use conventional fasteners such as screws, nut and bolt connectors, etc. Unless specifically otherwise disclosed or taught, materials for making components of the present invention are selected from appropriate materials such as metal, metallic alloys, fibers, fabrics, plastics and the like, natural or synthetic, and appropriate manufacturing or production methods including casting, extruding, molding and machining may be used. Furthermore, the members and components of the present invention may be constructed of solid formed pieces or hollow pieces, depending on the weight placed upon the tower while in use and the structural strength of the material used to make the tower.

Any references to front and back, right and left, top and bottom, and upper and lower are intended for convenience of description, not to limit the present invention or its components to any one positional or spatial orientation. As used herein, the terms "tower," "extendable tower," or "retractable tower" are intended to mean and/or encompass structures and/or apparatuses raised or raisable above a surface for providing a support column. Furthermore, each repetitive unit of the extendable tower may be referred to as a "section" or "link." Each section or link may be of increasing length for reasons described further herein. The strip of sections placed together may be referred to as a section chain.

Figure 1B:
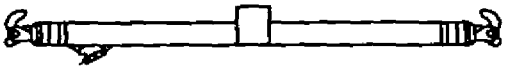
Figure 1A:
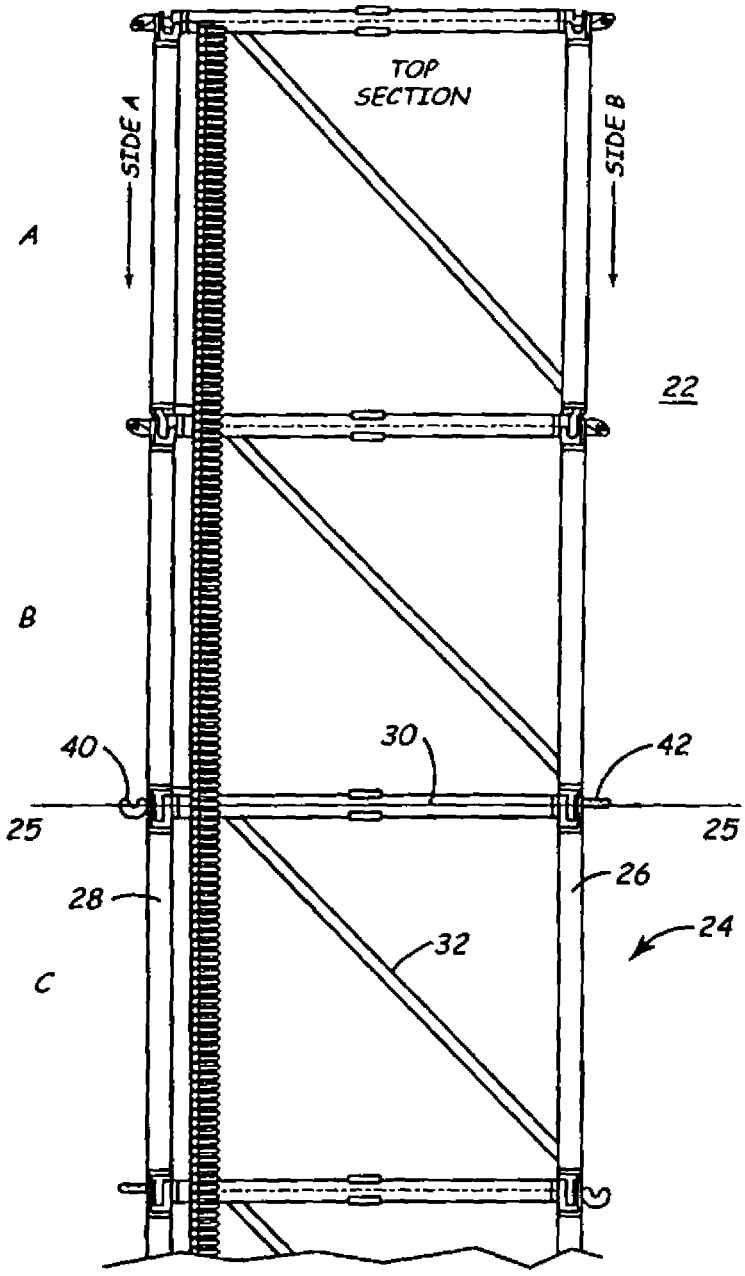
Figure 6:
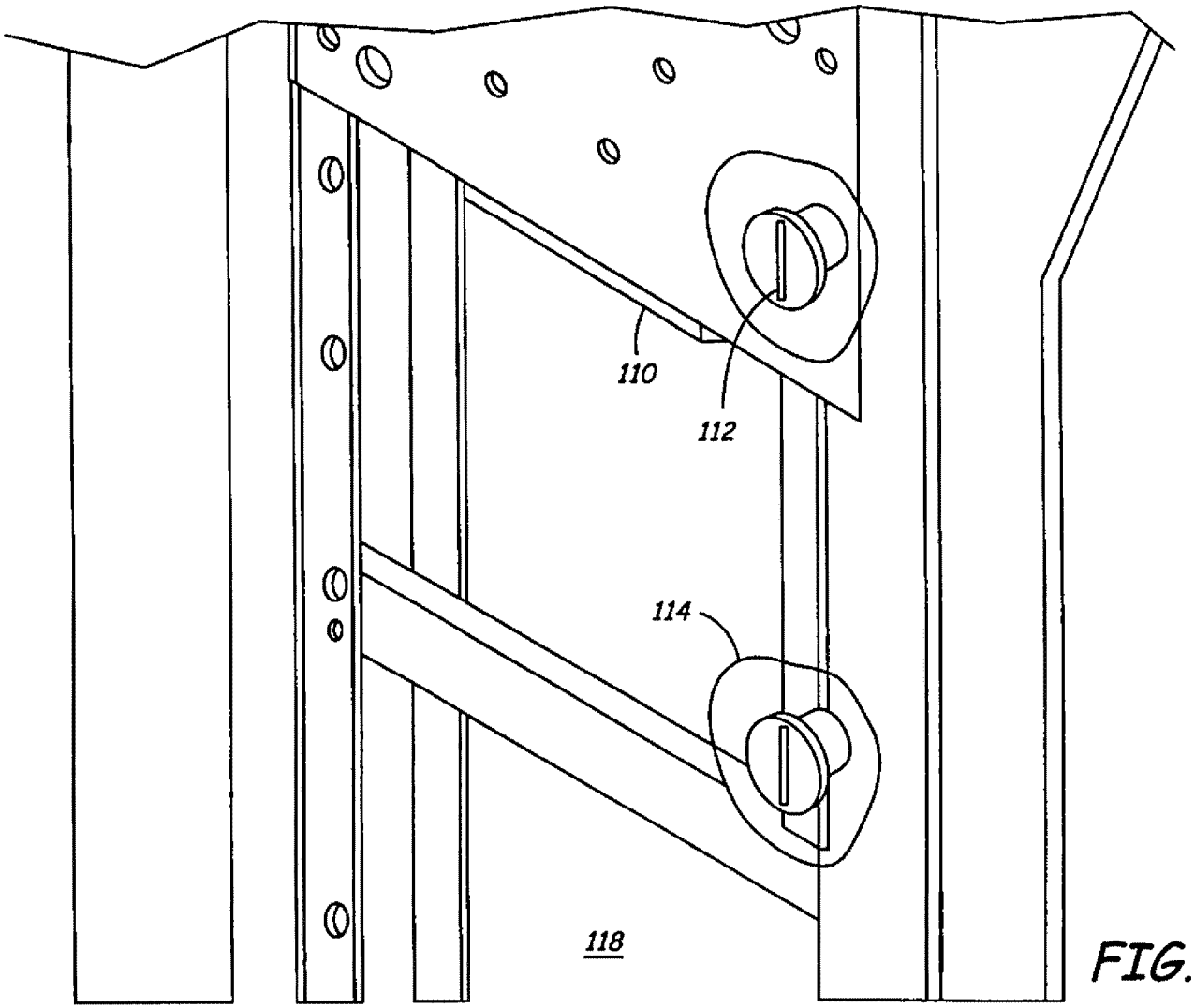
FIG. 6 is an isometric view of the guide tower with guide column of the present invention.
Figure 7:
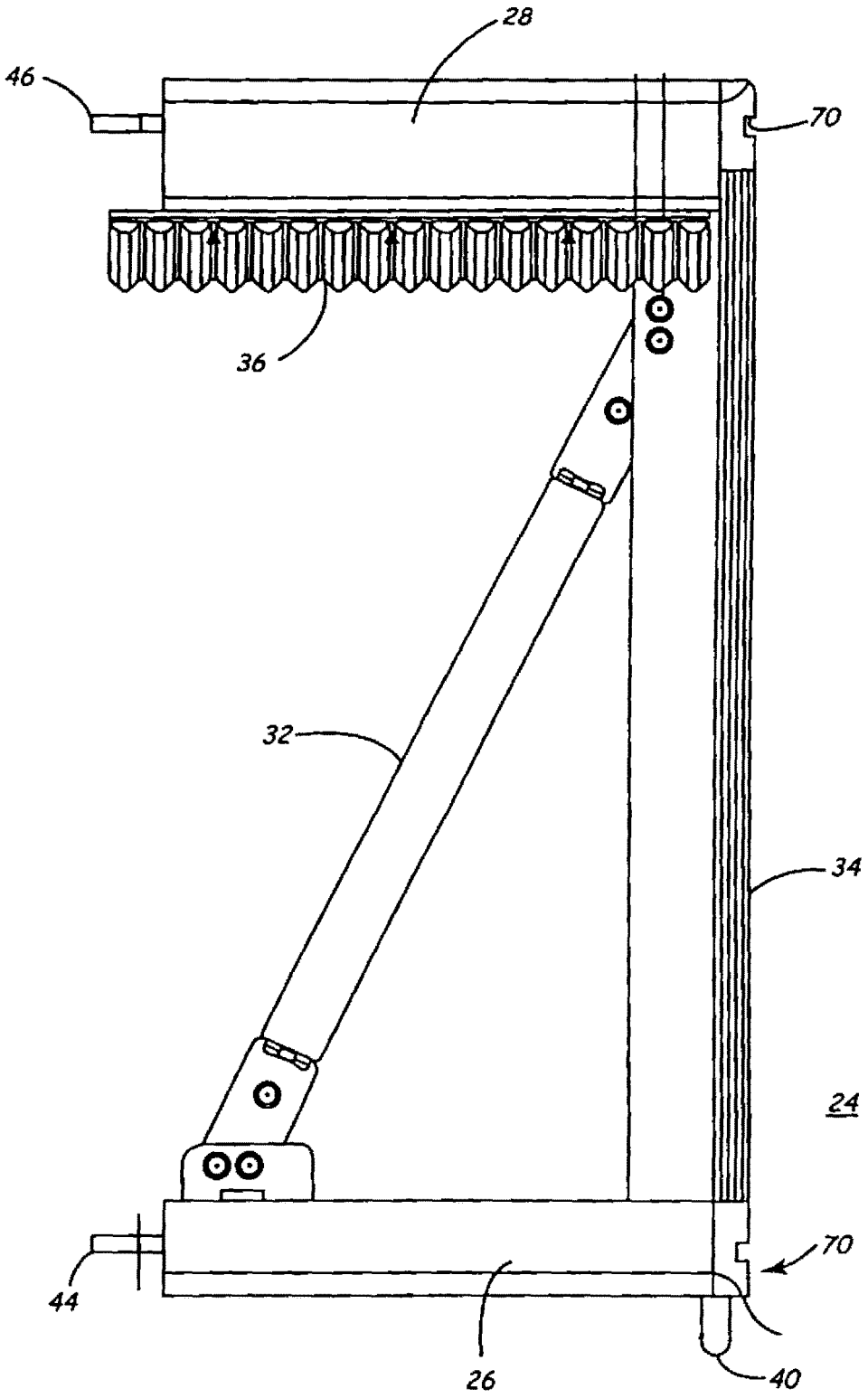
FIG. 7 is a rear view of a section of the section chain of the present invention.
Figure 8:
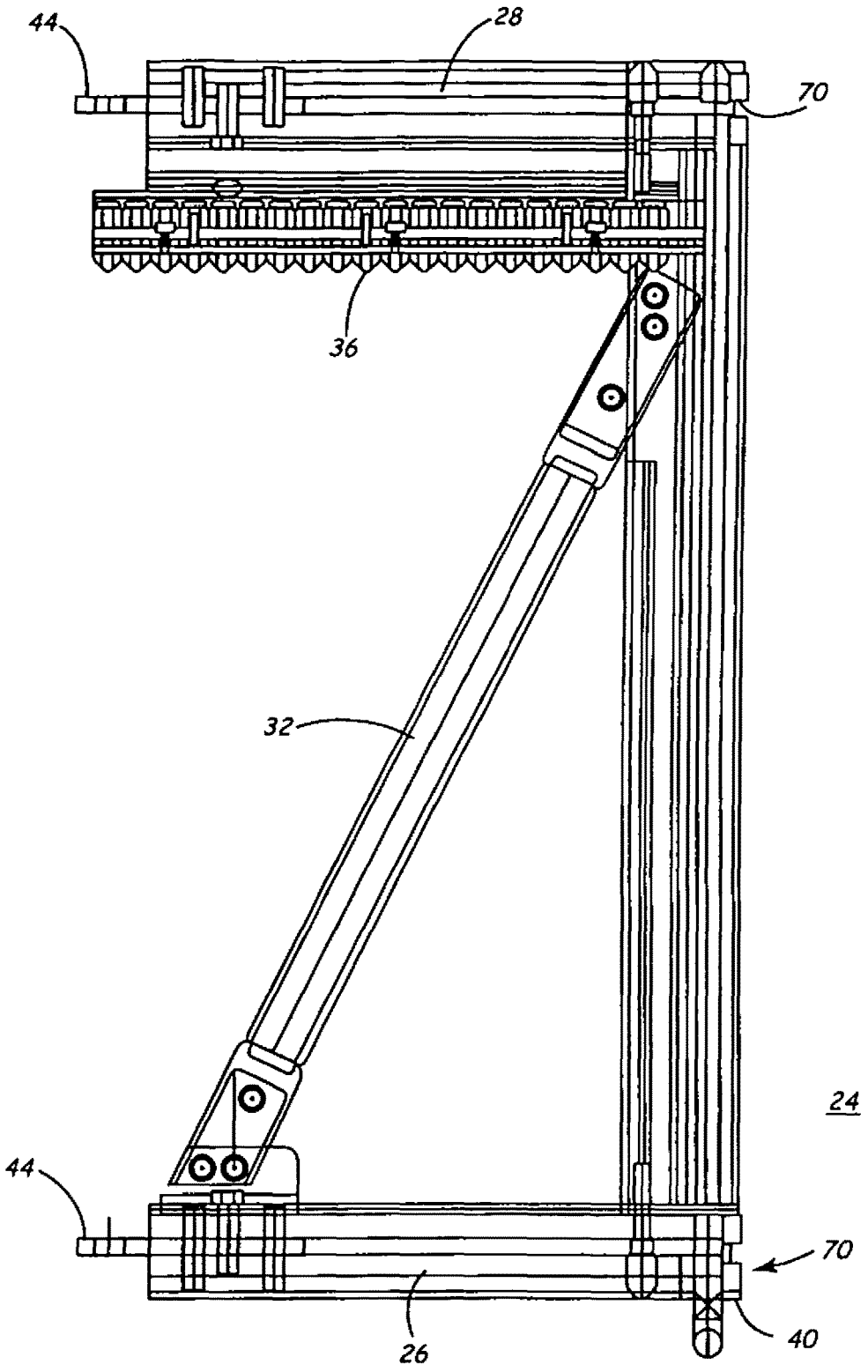
FIG. 8 is a rear view of a section of the section chain of the present invention.

As illustrated in FIGS 1*a* and 7, the retractable column 20 of the present invention in the extended position will be herein described. FIG. 1*a* shows a front view of a portion of one section chain 22. The section chain is comprised of a series of successive sections or links 24 connected in a pivotal relationship. The pivotal relationship of the successive sections 24 allows the sections 24 to pivot about a pivot axis extending through the space between the sections 24, as represented by line 25-25 in FIG. 1*a*.

Figure 10:
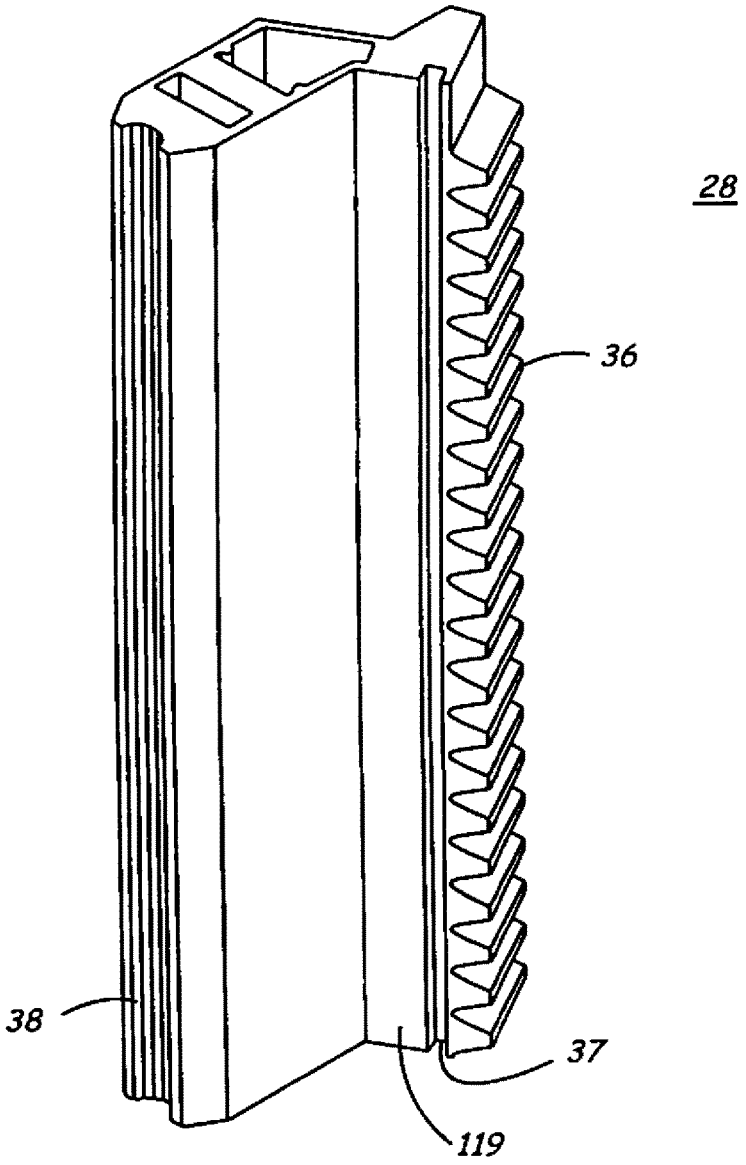
FIG. 10 is an isometric cut-away view of a portion of a vertical strut of the present invention with the teeth of the gear rack.
Figure 11:
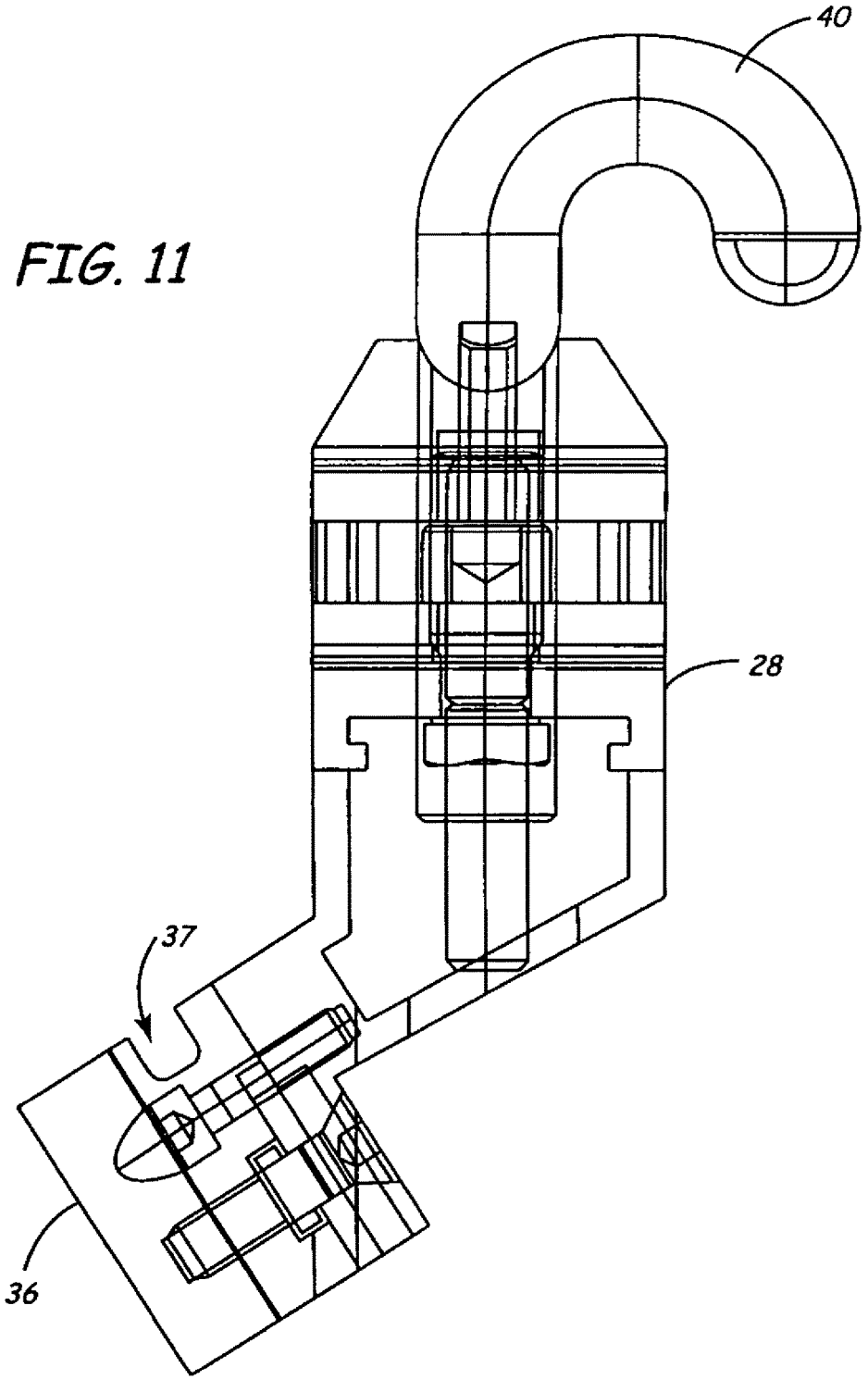
FIG. 11 is a cut away sectional view of the gear rack, section, and the chain connection member of the present embodiment.

As illustrated in FIG. 7, each section 24 further comprises vertical struts 26 and 28, a crossbar 30, a cross brace 32, a cross bar kicker 34, and a gear rack 36. The vertical struts 26 and 28 are disposed on each side of the section 24 and fixedly connected in a rectangular shape with the crossbar 30. The struts 26 and 28 may also be referred to by other names or constructed in other manners known to those reasonably skilled in the art. The cross brace 32 is fixedly secured across the interior of the section 24 to provide further structural support. The cross bar kicker 34 of the present embodiment is a triangular shaped protrusion integrally formed on the surface of the crossbar 30. Operably connected parallel to the vertical strut 28 on one side is the gear rack 36. The struts 26 and 28, crossbar 30, cross brace 32, and cross bar kicker 34 of the present embodiment are formed of extruded aluminum. The vertical struts 26 and 28 and the crossbar 30 are formed of substantially one piece or, in an alternative embodiment, bolted together. As illustrated in FIGS. 7, 10, 11, and 16, the gear rack 36 may be an integral portion of the vertical strut 28 on one side of the present embodiment. Furthermore, as illustrated in FIG. 10, one vertical strut 28 is further comprised of an indent guide 38. The indent guide 38 is formed out of one side of the strut 28. The utility of the indent guide 38 and the gear track 36 is further described herein.

As illustrated in FIGS. 1, 7, 11, and 15, each section of the section chain further comprises a chain connection member in the form of a pair of hooks 40 and a pair of blades 44. The blades 44 are rigidly secured to downwardly extend from the lower portion of each of the vertical struts 26 and 28. The chain connection members of the present embodiment are in the form of a question mark, with a straight shaft portion and a hook portion on the distal end of the shaft. Furthermore, as seen in FIGS. 2-5, the distal hook portion of the present embodiment resembles a C shape. In other embodiments the C may be shorter, longer, or altered into various other shapes that can accomplish the desired result. In the present invention description the chain connection member 40 will be referred to as a 'hook 40,' but this in no way limits the scope of the present invention chain connection member.

As is further illustrated in FIGS. 2-5, the distal hook end of the hooks 40 of the present embodiment are skewed at an angle to the angle at which the elongated shaft rests. The angle at which the distal hook portion is set preferably less than ninety degrees. Even more preferably, the angle of the hook portion is approximately 30 degrees.

Figure 9:
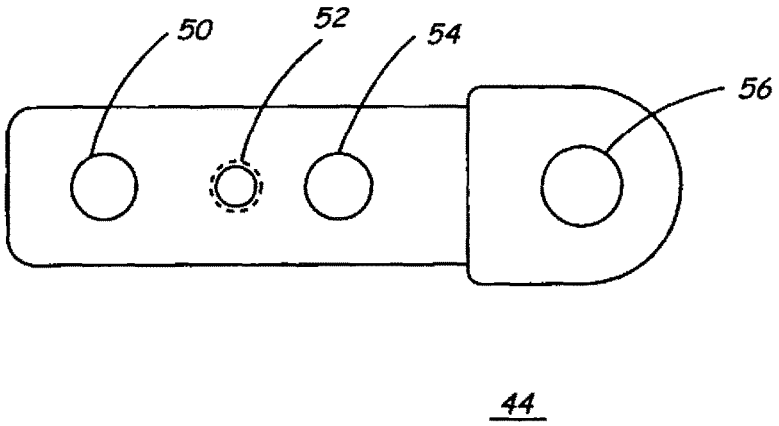
FIG. 9 is a front view of the blade of the present invention.

The hooks 40 of the present embodiment are furthermore secured to outwardly extend from the top portion of the crossbar 30. The blades 44, as illustrated in FIG. 9, comprise an oblong shape with a rounded end 48, the entire blade 44 having a series of holes 50, 52, 54, and 56 disposed thereon. The rounded ends 48 of the blades 44 protrude downwardly from the bottom portion of each vertical strut 26 and 28. A variety of pins are placed through corresponding holes in the strut to secure the rectangular portion of the blades 44 to the vertical struts 26 and 28.

As illustrated in FIGS. 2-5, the hook 40 further comprises a straight cylindrical rod portion 60, a hook portion 62, a tip 64, and a shoulder 66. The rod portion 60 may form the base of the hook 40 and the tip 64 is operably positioned on the end of the hook portion 62 which extends from the rod 60. The shoulder 66 juts outwardly from the rod 60. The shoulder 66 should be affixed in a position relative to the hook portion 62 so that the hook portion is presented at a desired angle when the rod portion and shoulder are inserted into shoulder receiving cavity 66a (shown in FIG. 16).

The tip 64 of the present embodiment is illustrated in FIGS. 2-5 as a pointed tip. The tip 64, however, may in fact be only slightly narrower than the hook 40 and thereby increase the interlocking engagement with other hooks 40. As may be appreciated, the tip 64 does not have to come to a point. A tip 64 that narrows toward the distal end, however, may be preferable because it facilitates the coupling of the hook 40 with hooks 40 from the adjacent sections.

The shoulder portion 66 of the hooks 40 when inserted into shoulder receiving cavity 66*a*, help to insure that the hooks 40 do not twist when pressure is placed upon the hook 40, either when the tower 20 is being raised or after the tower 20 is in position. Excessive pressure on the prior art hooks caused by twisting of the locking pins often caused the pins to shear. The present invention adds a shoulder 66 to the cylindrical rods 60 of the hooks 40 to prevent all of the pressure from being placed on the locking pins and shearing them, thus preventing the degradation of the tower 20 stability.

Figure 12:
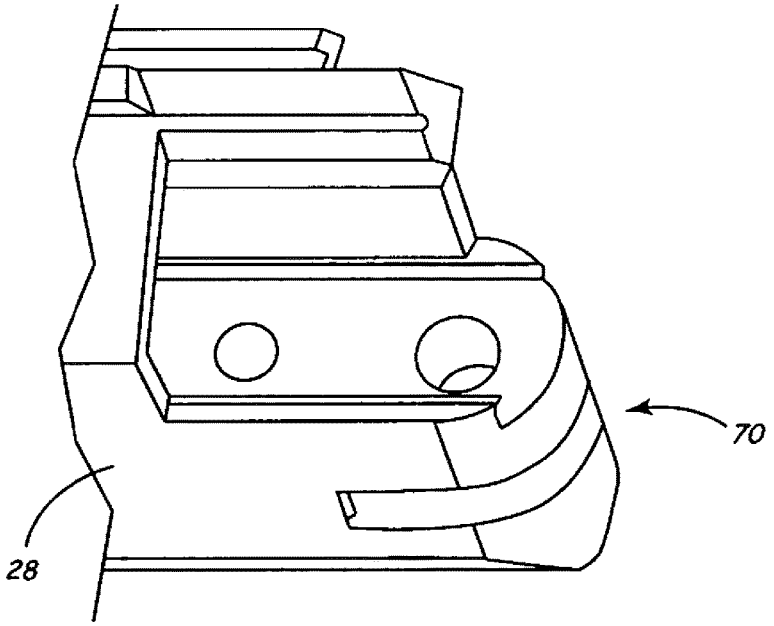
FIG. 12 is an isometric view of the saddle of the present invention.

As illustrated in FIGS. 1, 12, and 16, the successive sections 24 of the tower 20 section chain 22 are overlapped in a blade and saddle fashion (similar to a tongue and groove). The blade 44 of the higher section 24 is inserted into a saddle 70 of the lower section. After the blade 44 is inserted into the saddle 70, the cylindrical rod 60 portion of the hook 40 is then placed through holes 60a and 60b disposed on either side of the saddle 70, through the blade 44, and then securely fastened by pins, bolts, or by any other manner known to those in the art. FIG. 16 illustrates the rod 60 positioned through the holes 60a and 60b disposed on either side of the saddle 70 without the blade 44. The manner in which the blade 44 interacts with the rod 60 and the saddle 70 may be easily imagined by those skilled in the art. The pivotal connections of the blade 44 and the rod 60 on either side of the crossbar permits the upper section 24 to pivot versus the lower section 24 along an axis extending between the successive sections 24 in the section chain 22, represented by line 25-25 in FIG. 1. The gear teeth 36 of successive sections 24 are also formed in such a way that enables them to pivot in relationship to one another.

The interaction of the cylindrical rod 60 with the blade 44 of the next successive section 24 also allows the sections 24 of the section chain 22 to be secured in a way that the whole section chain 22 can be drawn up by a drive mechanism 72 (not shown), but still allowing the sections 24 to be in a pivotal relationship with one another. Each side of the section 24 in the section chain 22 has one of the hooks 40 for engaging a similar hook 40 on an adjacent section 24. The saddle 70 and blade 44 arrangement may present a hook 40 on both sides of each successive section 24 of the section chain 22. The blade 44 and saddle 70 combination increases the reliability and structural integrity of the present invention tower 20.

As illustrated in FIGS. 1-5, 7, 8 and 15, and as noted above, each section of the section chain 22 may comprise two hooks 40. The hooks 40 form a locking engagement with a corresponding hook 40 on an adjacent section chain 22 to form the tower 20. The hooks 40 are shaped and positioned so that they can be readily hooked together by concurrently raising the adjacent sections of the section chains 22, thereby raising the hooks 40 into connected cooperation with one another. Once the hooks 40 are in connected cooperation, the hooks 40 securely bind the section chains 22 to one another, forming the rigid tower 20 of the present invention. Similarly, to unhook or decouple the hooks 40, the adjacent sections of the section chains 22 may be concurrently lowered, thereby allowing the hooks 40 to decouple and return to their original position. The removable connection of the adjacent section chains 22 permit each of the sections 24 that form the retractable tower 20 to be rolled up and stored on a separate take up mechanism 80. The take up mechanisms 80 are further described below.

With reference to FIGS. 1-5, the hooks 40 will be further herein described. The hooks 40 extend laterally outward from the side of the crossbar 30 of each section in the section chain 22 and are fixedly connected to the same. Each section 24 of the section chain 22 further comprises one hook 40 that extends perpendicularly and co-planar with the plane of section 24 and one that is substantially perpendicular to the plane of section 24. Those hooks that extend directly perpendicular will be referred to herein as hooks 40, those that are offset will be referred to herein as offset hooks 42. FIG. 1 illustrates both the hooks 40 and the offset hooks 42 extending outward from the section chain 22.

As illustrated in FIGS. 1 and 23, the hook 40 on one side of the section 24 of the section chain 22 has an offset hook 42 on the other side. In the next successive section 24 of the section chain 22, the sides on which the offset hooks 42 and the hooks 40 are present may be reversed. The next successive set of offset hooks 42 and hooks 40 may be fixedly connected in a similar manner to the first section 24, so that an alternating pattern results. The adjacent sections 24 to either side should have an offset hook 42 or a hook 40 to mate with the corresponding hook 40 or offset hook 42. Other arrangements of hooks 40 and offset hooks 42 may easily be implemented as long as the hooks 40 and 42 interact with the corresponding type to form the proper engagement.

The offset hooks 42 have one end extending upward and through the opening of the corresponding hook 40. It is the interlocking engagement formed between hook 40 and hook 42 that provides the lateral connection to hold adjacent section chains 22 in a position next to each other. The adjacent struts 26 and 28 contact each other to prevent the inward collapsing of the section chains 22 while the offset hooks 42 and the other hooks 40 prevent the sections of the section chains 22 from collapsing outward. In this way, successive couplings may be achieved in a more efficient manner. When multiple hooks 40 are connected to successive vertical struts as shown, the present invention tower may be formed.

The rotational engagement of corresponding hooks 40 will be described. The struts 26 and 28 on the lower section 24 rotate in response to being driven up by a drive mechanism 72. In doing so, the hook 40 may be rotated about its central axis. The adjacent offset hook 42 is also rotated about its central axis in the same manner. The use of the hooks 40 and the offset hooks 42 permit the operator to actuate the drive mechanism 72 and thereby rotate the hooks 40 until they are coupled into interlocking engagement as the struts 26 and 28 reach a vertical position. The present invention permits the user to couple the sections 24 of the section chains 22 into interlocking engagement through pivotal rotation of the section chains 22 from the horizontal to the vertical position. As may be appreciated by those skilled in the art, as the corresponding sections 24 of the section chain 22 rotate in different directions during the retraction of the tower 20, the hooks 40 decouple from their interconnecting engagement.

In the present invention, the point 64 on the end of the hook portion 62 of the hooks 40 and 42 facilitate the consistent and secure coupling engagement of corresponding hooks 40, as the blunt end of the prior art hooks were easily bound against the corresponding hook without effectuating the proper locking attachment. Although both hooks 40 have a pointed C shape 62 for engaging with one another, the offsetting of one of the hooks 42 in a hook pair permits one to couple or decouple the hooks from one another solely through the pivotal rotation of the end of each section in the section chain 22 as the link chain 22 is lowered.

As illustrated in FIGS. 13, 14, 16, and 20-21, the attachment of the gear rack 36 to the strut 28 will be herein described. As illustrated in FIGS. 20 and 21, the gear rack 36 of the present invention is attached to the strut 28 utilizing recessed fasteners 77. The recessed fasteners 77 are placed in an alternating manner so that some of the fasteners 77 have the head exposed between the teeth of the gear rack 36, as illustrated in FIG. 21, and so that minimal gear rack 36 cross-sectional area is lost. Other fasters 77 are illustrated in FIG. 20 where the head of the fastener 77 is exposed from the rearward side of the gear rack 36, as illustrated in FIG. 16. In this manner the gear rack 26 is affixed to the strut 28 in a secure fashion.

The fasteners 77 above are not able to take the entire shear weight of the tower 20 alone. The present embodiment, as illustrated in FIGS. 13*a-c*, and 16, illustrate a T slot 79 machined in to the back side of the gear rack 36. This T slot 79 fits over a T fastener machined onto the gear rack 36 as illustrated in FIG. 16. (The T fastener is not shown). When the gear rack 26 is placed against the strut 28 the T slot 79 fits over the T fastener. This T fastener and T slot 79 combination help to secure the gear rack 36 to the section 24 and the strut 28.

In addition to the T slot 79 and corresponding T fastener, illustrated in FIG. 16 are a number of keys 81. The keys 81 of the present embodiment are quarter inch stainless steel slugs which are driven horizontally into corresponding grooves 83. The keys 81 of the present embodiment are designed to take the majority of the shear stress placed upon the gear rack 26 when raising and lowering each section 24. As may be appreciated, each gear rack 26 will have thereon the weight of tower 20 while that gear rack 36 is in connection with the driver motor and being raised. The bolts 77, and the T slot 79 and T fastener connections, of the present embodiment are therefore not designed to take the entire shear force generated by this weight. In addition, the strength of gear rack 36 is not reduced by welding.

The improved attachment of the gear rack 36 to the vertical strut 28 represents an improvement in the present invention over the prior art. The improved connection of the gear rack 36 insures that the gear rack 36 will not come loose even under the most adverse circumstances. If the gear rack 36 were to twist in any manner, come loose, or possibly even come off, then the section 24 would not be properly engaged by the drive mechanism 72 and would disrupt the coupling of the adjacent section chains 22 whereby reducing the strength of the resultant tower.

As illustrated in FIG. 22, the take up mechanism 80 of the present invention will be herein further described. The nesting relationship of the take up mechanism 80 with the successive sections 24 of the section chain 22 present an advantage of the present invention tower 20. FIG. 22 shows a sectioned portion of the nesting relationship of a series of sections of a section chain 22. Each of the successive sections 24 of the section chain fit over the earlier sections 24 already taken up on the square shaped box core 86. The nesting relationship of the successive sections 24 in the section chain 22 allow the tower 20 of the present invention to be stored in a relatively small area.

As illustrated in FIG. 22, the take up mechanism 80 comprises a square box shaped core 86 with four face members 90, 92, 94, and 96. Each face member 90, 92, 94, and 96 support and store the sections 24 of the section chain in a square shaped roll as the tower is retracted. As illustrated in FIG. 23, extending through the center of the take up mechanism is a pivot rod 97 that is rotatably supported on one end by a first roller brace 98 and on the opposite end by a second roller brace 100. As illustrated in FIG. 22, the first and second roller braces 98 and 100 roll along a first track 102 and a second track 104 (not shown) which extends in an upwardly slanted manner in an outwards direction from the tower 20 base. As sequential sections of the section chain 22 are rolled around the square box shaped core 86, the rollers 98 and 100 allow the rack to move in an outwards direction to receive the next section 24. When a complete section 24 is folded onto the square box shaped core 86, the pivot point between the sequential sections allows the box shaped core 86 to travel, via the rollers 98 and 100, back down the slanted tracks 102 and 104, readying the system for the take up of the next sequential section 24 of the tower 20. The slope of the first track 102 and the second track 104 provide an inward force to the take up mechanism 80. The interaction of the linked drive mechanism and the roller braces 102 and 104 provide a constant and concurrent take-up of each side of the tower 20 as the tower 20 is retracted. An identical system may connect the roller braces to the take up mechanism and the section chains that form the other sides of the retractable column.

In order to compactly store the sections of the tower 20 on the take up mechanism, the section chain 22 sections 24 may be of increasing length. In other words, as illustrated in FIG. 1*a*, the sections 24 at the top of the section chain 22 may have a length A and the successive section 24 may have a length B, the length B being slightly shorter than length A. Similarly, the next successive section 24 may have a length C that may be slightly shorter than length B. The purpose of the different size sections 24 is to permit the individual sections 24 to be wound on to the square take up mechanism 80 in a layered fashion, as illustrated in FIG. 22. As more sections 24 of the section chain 22 are wound on to the take up mechanism 80, the diameter of the square shaped box 86 increases, requiring a longer section 24 to extend across the face of the take up mechanism 80 to complete the next layer of the box 86. This may be easily seen by looking at FIG. 22. As will be appreciated by one skilled in the art, other take up mechanisms 80 may not be box shaped, for example such mechanisms may have five or six sides instead of four.

As illustrated in FIGS. 7 and 22, the operation of the kicker 34 will be herein further described. The kicker 34 of the present invention facilitates the correct stacking of the successive sections 24 in the section chain 22 when being rolled up in the take up mechanism 80. As can be seen in FIG. 22, each section 24 becomes stacked on a section 24 that is actually four sections lower down in the tower 20. As the stack as a whole rolls back down the slope by action of the pivot rod 97 and the first and second roller braces 98 and 100, the whole stack will rotate counterclockwise (from the perspective of FIG. 22). As the stack rolls and rotates in this manner, the topmost edge will rotationally move toward the section 24 being sequentially stacked. The kicker 34 ensures that the queued section 24 is properly aligned with the section 24 underneath it in the take up mechanism 80. The kicker 34 insures that the new section 24 is not askew, either too high or low, or rotated at an angle, relative to the section 24 below it in the stack. As may be appreciated, this is accomplished because if the new section 24 on the stack aligns in an incorrect manner, it will slip off kicker 34 and seat itself incorrectly.

As illustrated in FIGS. 6, 7, 18, and 19, the present invention further comprises a guide column 110, an upper guide roller 112, a lower guide roller 114, an at least one shim 116, and a guide tower 118. The guide tower 118 resides in the middle of the three section chains 32 of the tower 20 as it forms. The guide tower 118 is on top of and houses the drive mechanism and drive teeth (not shown). The guide column 110 is fixedly attached to the guide tower 118 so that it operatively rests along the inside of each of the section chains 22. The upper guide roller 112 and the lower guide roller 114 are fixedly connected to the guide tower 118 to operably interact with the opposite edge from the indent guide 38. The shims 116 are fixedly attached to the guide tower 118 in a position behind the vertical struts 26 and 28 to insure the proper vertical alignment of the sections of each section chain. The accompanying figures generally show the rollers 112 and 114, shim 116, etc., that interact with one section chain 22 of the three that may be connected to form the tower 20 of the present embodiment. It is generally understood that each section chain 22 will have the corresponding structures described herein for guiding the section chain 22 as it is erected by the drive mechanism 70.

As illustrated in FIGS. 1, 6, 17, 18, and 19, the above described guide tower 118 and the attachments thereto improve the stability and performance of the present invention tower 20. The upper and lower guide rollers 112 and 114 act to operatively engage the sections 24 as they are raised. The guide rollers 112 and 114 are adjustable to insure that each section 24 is guided into the correct position, thus insuring the correct locking engagement of the corresponding hooks 40 and 42. In the present embodiment, the guide rollers 112 and 114 engage a rolling surface 113 on the back of the gear rack as illustrated in FIG. 16. The rolling surface 113 of the gear rack 26 is substantially smooth and of a shape that allows the rollers 112 and 114 to rotationally engage and guide the same.

In alternative embodiments, a person skilled in the art may add a greater number of guide rollers to insure the correct positioning of the section chains 22 as they are raised and coupled to one another. As may be appreciated by one skilled in the art, having a multiple roller system may distribute the stress of guiding the sections 24 of the section chains 22 among more rollers, thereby improving the alignment of the sections 24. In the present embodiment, the guide rollers 112 and 114 may utilize a ceramic impregnated fiber roller bushing, a brass washer, a hard coated aluminum roller, and a steel roller shaft.

As illustrated in FIG. 17, the present embodiment further comprises interior rollers 115 and 117. Rollers 115 and 117 are operably attached to jut from below the shim 116 of the present embodiment guide tower. FIG. 19 illustrates the lower guide roller 114 and an interior roller 117. The lower guide roller 114 rotationally engages rolling surface 113 of the gear rack 36 which is pointed internally toward the guide tower 118. The rolling surface 119 is on the opposite side of, and operably connected to, the gear rack 36 from the rolling surface 113 previously described. The interior roller 117 may rotationally engage a rolling surface 119 on the other side of the gear rack 36 as illustrated in FIG. 10. Between the two guide rollers 112 and 115, the gear rack 36, and thus the entire section 24 is guided into a position that insures the accurate coupling of the hooks 40 and 42. The lower guide roller 114 operates in substantially the same way at a position below that of the upper guide roller 112 with the interior roller 117, guiding each successive section 24 into a position that facilitates the coupling engagement required to form the tower 20.

The interior guide rollers 115 and 117 may present another advantage to the present invention in that it provides another surface with which to guide the sections 24 of the section chains 22 into the proper position to couple the hooks 40 and 42. Furthermore, the interaction of the interior guide rollers 115 and 117 with the rolling surface 119 may distribute more of the stress of guiding the section chains 20 into position, further reducing the wear on the other guide rollers 112 and 114, the shims 116, and the guide tower as a whole 118.

As illustrated in FIGS. 10 and 19, the gear rack 36 of the present embodiment further comprises an indentation 37. The indentation 37 operably interacts with a protrusion 39 (illustrated in FIG. 19). The protrusion 39 is operably positioned to extend from the shim 116 and in a vertically offset manner from the interior guide rollers 115 and 117 so that it does not bind in any way with the same. The protrusion 39 may interact with the indentation 37 as yet another guide for the gear rack 36. The indentation 37 and protrusion 39 keep the gear rack 36, and thus each section 24, in the desired position and path for optimum coupling along with the guide rollers, shims, etc. The corresponding shape of the protrusion 39 and the indentation 37 may be designed in any manner that will accomplish the guiding of the gear rack 36. While the rollers 112, 114, 115, and 117 operably engage the gear rack 36 on a fairly continuous basis across the rolling surface 113 of the gear rack 36, the protrusion 39 does not continually rub against the indentation 37, but rather is a step that prevents the gear rack 36 from straying too far from the desired point.

The shim 116 may operably engage one or both of the vertical struts 26 and 28 and the guide tower 118 in such a manner to align the sections 24 into the correct position, acting in coordination with the guide rollers 112 and 114. The guide column 110 may furthermore be a structure placed in a fixed relationship with the guide tower 118 in such a manner so that some of the above rollers 112 and 114 and shims 116 may be affixed thereon. The taller the guide tower 118, the greater the assurance that the sections 24, and hence the hooks 40 and 42, will be in alignment as the tower 20 is raised into position. The interaction of the take up mechanism 80, which provides a stable and reliable platform for storing the section chains 22, and the improved alignment of the sections chains 22 as they are raised, provides for a reliable and structurally sound retractable tower.

As illustrated in FIG. 17, the drive mechanism 72 is located within the confines of the guide tower 118 with the drive gear 73 located in such a manner to cooperatively interact with the gear rack 36 of each successive section 24, thereby pulling/pushing the tower 22 into an upright position. The drive mechanism 72 may comprise an electric motor that drives the gears; alternatively, other types of drive motors and arrangements may also be utilized.

In alternative embodiments, a drive reduction mechanism with a drive motor, such as an electric motor, allows the user to lift the sections of the section chain upward even though there may be a load on top of the retractable column. The mating hooks 40 and 42, the various rollers 112 and 114, guides 110, etc., allow an 80 foot tower of the present invention, with a 5000 pound payload, to withstand winds in excess of 50 miles an hour. Further refinements in material and manufacture of the present embodiment may increase the height and payload capacities of the present invention without changing the nature and scope thereof.

In still another embodiment, the tower 20 may be formed by raising the sections in the inside of the guide tower walls. In this embodiment, the rollers, shims, etc. would point inwards and engage the sections as they pass through the inside of the tower.

As illustrated in FIGS. 24-29, in another alternative embodiment, a second outer guide tower 160 is positioned around the tower 20, the second outer guide tower 160 including a generally rigid triangular shape. The outer guide tower 160 may include three outer posts 130, 132, 134 and three reaction rings 136, 138, and 140 affixed to each other by three vertical ring posts 170. Each reaction ring 136, 138, and 140 may further include a number of rollers 162 and 163. In this embodiment, the three posts 130, 132, 134 are rigidly assembled in a three corner design and affixed to a base. The guide tower 160 further comprises three tongues 142, 144, and 146 which extend horizontally from each corner of the guide tower 160. The guide tower 160 is connected to the three outer posts 130, 132, and 134 by the three reaction rings 136, 138, and 140 and the three tongues 142, 144, and 146. The oversized holes in the three tongues 142, 144, and 146 allow the guide tower 160 to move in a horizontal plane in both the X and Y directions, as further described below, while retaining its generally rigid rectangular shape. Movement of the guide tower 160 in the X and Y directions allows a slight movement of the tower 20 as the tower 20 is being raised. This full engagement significantly contributes to minimizing tower deflection while the tower is being raised or lowered or while in a stationary, raised position. When raising the tower 20 in windy conditions, stress on the tower 20 may cause the tower 20 to bind against the rollers 162 of the second guide tower 160 and therefore interfere with the coupling of the hooks 40 and 42 as the tower 20 is pushed by the wind. The outer guide tower 160 allows the tower 20 to move some amount in the X and Y directions but prevents the tower 20 from moving so far as to disengage the drive mechanism 72 from the gear rack 36 of each section 24. The rollers 162 and 163, which are mounted on each reaction ring 136, 138, and 140, continually contact and exert pressure on the vertical corners of the tower 20 and force the tower 20 gear racks 36 to remain fully engaged with the drive mechanism 72 located in the inner guide tower 118. The operation of the reaction rings 136, 138, and 140 will now be described in terms of reaction ring 136.

The reaction ring 136 is further illustrated in FIG. 26*a* and 26*b*. As illustrated, the reaction ring 136 may further comprise a bolt 148 and a washer 150. The tongue 142 is placed on top of the post 130 and the washer 150 is placed on top. As illustrated in FIG. 26*a*, the tongue 142 has a circular cutout area that is wider than the shaft of the bolt 148. The bolt 148 is placed through the washer 150, through the tongue 142, and then threaded and securely fastened into the top of the post 130. The bolt 148 firmly presses the washer 150 on top of the tongue 142 and to the top of the post 130. The pressure exerted by the bolt 148, however, is selected so that when certain stresses are placed on the tower, the tongue 142 will slide a given distance over the top of the post 130, but still be secured from sliding off of the post 130 by action of the bolt 148. As may be appreciated, various additions or alterations could be made to such an arrangement without changing the nature and scope of the present invention, for example, the addition of a spring or other shock system to soften the force of contact between the inside diameter of the tongue 142 and the side of the bolt 148. As may be appreciated, the reaction ring may be constructed in a number of different manners. For example, the bolt and the post may be substantially formed of one solid piece whereby the bolt has a narrow head that allows for the placement of the tongue over the top of the head, and after which a vertical stop is attached to the head of the bolt to prevent the tongue from slipping off of the top. In addition, other ways of implementing X, Y horizontal movement in this manner may be imagined by those skilled in the art.

As a safety measure, in an alternative embodiment solenoid activated dogs may be provided that engage the corresponding gear racks on the back of the link braces. The solenoid activated dogs may stop the downward movement of the tower should the power supply be cut. Dogs of this nature are well known to those reasonably skilled in the art. The top end of the dog may contain teeth that are normally spaced apart from gear rack teeth. If power should be cut off to the system, a solenoid release dog may rotate clockwise and into interlocking engagement with the teeth, thereby stopping the downward motion of the retractable column. Similarly, a pivotal dog is located in a normally spaced relationship to the gear rack teeth.

As illustrated in FIGS. 27-29, many set ups of the present invention may be utilized in different manners. Some of these set ups may incorporate a mobile platform, much like an ordinary trailer, to carry the tower 20 apparatus to a site where it is raised. The size of the trailer and the weight of such a mobile set up may depend on the height and structural load capability of the tower. Furthermore, fixed in place retractable towers may also be constructed. These fixed in place embodiments may be ideal where a tower is considered unsightly when not in use. The retractable tower may be covered over, with doors that open when the tower needs to be extended. Those reasonably skilled in the art may imagine a variety of ways to implement the present invention.

As illustrated in FIG. 29, in another alternative embodiment the tower 20 may be moved upwards and guided through the interior of the guide tower 160. As may be seen in this illustration, the rollers may point to the interior and guide the tower as it is raised through the same. As may be appreciated, further design changes may be made in this manner without changing the nature and scope of the present invention.

The information and examples described herein are for illustrative purposes and are not meant to exclude any derivations or alternative methods that are within the conceptual context of the invention. It is contemplated that various deviations can be made to this embodiment without deviating from the scope of the present invention. Accordingly, it is intended that the scope of the present invention be dictated by the appended claims rather than by the foregoing description of this embodiment.

The invention claimed is:

1. A method for erecting a retractable tower, the method comprising the steps of:

providing a plurality of chains wherein each chain is formed from at least two vertically adjacent individual sections, each section having an outer surface, and vertically adjacent sections being pivotally mounted to each other to pivot about a pivot axis;

providing first and second hooks mounted to lateral sides of each individual section, each hook including a cylindrical rod portion with a central axis and a curved hook portion for lockably engaging the curved hook portion of a laterally adjacent hook, the cylindrical rod portions of the first and second hooks of each individual section being substantially on and parallel to the pivot axis of that section; wherein the curved hook portion of each hook is angled relative to the rod portion and the curved hook portion defines a plane which is angled relative to the central axis of the rod portion;

lifting the plurality of chains so as to cause the pivot axes of laterally adjacent sections to lie substantially within a common plane thereby moving the hook portions of laterally adjacent sections to lockably engage with one another to couple the adjacent chains together with the outer surfaces of the sections of each chain forming a face of the tower;

angling the curved hook portion of each hook relative to the rod portion with the curved hook portion defining a plane which is angled relative to the central axis of the rod portion;

positioning the first and second hooks on individual sections to have the angled hook portions of lockably engaging hooks of laterally adjacent sections engage each other as the chains are lifted; and angling the hook portion at an acute angle relative to the axis of the cylindrical rod.

* * * * *